US012618609B2

(12) United States Patent
Lee et al.

(10) Patent No.: US 12,618,609 B2
(45) Date of Patent: May 5, 2026

(54) REFRIGERATOR

(71) Applicant: LG ELECTRONICS INC., Seoul (KR)

(72) Inventors: Bumsang Lee, Seoul (KR); Daekee Shin, Seoul (KR); Insun Yeo, Seoul (KR); Hophil Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 326 days.

(21) Appl. No.: 18/213,035

(22) Filed: Jun. 22, 2023

(65) Prior Publication Data

US 2023/0417475 A1 Dec. 28, 2023

(30) Foreign Application Priority Data

Jun. 23, 2022 (KR) ..... 10-2022-0077127
Nov. 3, 2022 (KR) ..... 10-2022-0145207
Feb. 16, 2023 (KR) ..... 10-2023-0020532

(51) Int. Cl.
*F25D 23/02* (2006.01)

(52) U.S. Cl.
CPC ..... *F25D 23/028* (2013.01); *F25D 23/025* (2013.01); *F25D 2323/023* (2013.01); *F25D 2323/024* (2013.01)

(58) Field of Classification Search
CPC ..... F25D 2323/023; F25D 23/025; F25D 2323/024; F25D 23/028; F25D 23/02; F25D 2400/40; E05F 3/20; E05D 11/0054; E05Y 2900/31
See application file for complete search history.

(56) References Cited

U.S. PATENT DOCUMENTS 8,388,078 B2 3/2013 Kwon et al.
10,492,629 B1 * 12/2019 Cunningham ..... A47F 3/0434
2010/0231110 A1 * 9/2010 Choi ..... E05D 5/02 16/382
2010/0307188 A1 * 12/2010 Kwon ..... F25D 23/028 62/449

(Continued)

FOREIGN PATENT DOCUMENTS

CN 115522830 A * 12/2022 ..... E05D 5/14
EP 3232144 7/2021

(Continued)

OTHER PUBLICATIONS

International Search Report dated Oct. 11, 2023 issued in Application No. PCT/KR2023/008684.

(Continued)

*Primary Examiner* — Hiwot E Tefera
(74) *Attorney, Agent, or Firm* — KED & ASSOCIATES, LLP

(57) ABSTRACT

A refrigerator includes a main door rotatably provided in the cabinet by a first hinge to open and close the storeroom, and a sub door disposed between the main door and the storeroom, rotatably provided with respect to the main door by a second hinge, and defining a storage space disposed inside the storeroom in a closed state, and in this case, the first hinge and the second hinge are bent at the same bending angle and are disposed in parallel to each other or overlap each other.

29 Claims, 18 Drawing Sheets

(56) References Cited

U.S. PATENT DOCUMENTS

| | | | | |
|---|---|---|---|---|
| 2011/0023528 | A1* | 2/2011 | Kwon | F25D 23/028 62/449 |
| 2012/0286639 | A1* | 11/2012 | Lee | F25D 23/00 312/405.1 |
| 2014/0132144 | A1* | 5/2014 | Kim | E05D 11/0081 312/405 |
| 2016/0123654 | A1* | 5/2016 | Lee | E05D 5/02 312/405 |
| 2017/0176089 | A1* | 6/2017 | Ramm | E05D 7/0027 |
| 2017/0188721 | A1* | 7/2017 | Park | F21V 15/01 |
| 2017/0328624 | A1 | 11/2017 | Yu et al. | |
| 2018/0031302 | A1* | 2/2018 | Park | F25D 23/028 |
| 2018/0187952 | A1* | 7/2018 | Lv | E05D 11/0054 |
| 2018/0310726 | A1* | 11/2018 | Oh | A47F 3/0434 |
| 2019/0003224 | A1* | 1/2019 | Reuter | F25D 23/028 |
| 2020/0025438 | A1* | 1/2020 | Liu | F25D 23/025 |
| 2020/0281372 | A1 | 9/2020 | Oh et al. | |
| 2021/0396455 | A1* | 12/2021 | Jang | E05D 7/081 |
| 2022/0003028 | A1* | 1/2022 | Chen | F25D 23/025 |

FOREIGN PATENT DOCUMENTS

| | | | | |
|---|---|---|---|---|
| JP | H10-197132 | | 7/1998 | |
| JP | H11-51537 | | 2/1999 | |
| KR | 20-0164322 | | 2/2000 | |
| KR | 10-2015-0015327 | | 2/2015 | |
| KR | 10-2015-0087524 | | 7/2015 | |
| KR | 10-2016-0019489 | | 2/2016 | |
| KR | 10-2021-0046867 | | 4/2021 | |
| KR | 10-2021-0148686 | | 12/2021 | |
| WO | WO-0171264 | A1 * | 9/2001 | F25D 23/028 |
| WO | WO 2004/029528 | | 4/2004 | |

OTHER PUBLICATIONS

Extended European Search Report dated Nov. 21, 2023 issued in Application No. 23180902.1.

Korean Office Action dated Apr. 21, 2025, issued in Application No. 10-2022-0145207.

Australian Office Action dated Nov. 4, 2025 issued in Application No. 2023288354.

* cited by examiner

REFRIGERATOR

CROSS-REFERENCE TO RELATED APPLICATION(S)

This application claims the benefit of Korean Patent Application No. 10-2022-0077127, filed in Korea on Jun. 23, 2022, Korean Patent Application No. 10-2022-0145207, filed in Korea on Nov. 3, 2022, and Korean Patent Application No. 10-2023-0020532, filed in Korea on Feb. 16, 2023, which are hereby incorporated by reference as if fully set forth herein.

BACKGROUND

1. Field

The present disclosure relates to a refrigerator, and more particularly to a refrigerator for efficiently configuring an internal space of a storeroom and opening and closing the internal space.

2. Background

In general, a refrigerator is a device that includes a compressor, a condenser, an expansion valve, an evaporator, and the like and freezes or refrigerates food or the like by discharging cold air generated by a refrigeration cycle and lowering the temperature inside the refrigerator (inside a storage room).

A refrigerator generally includes a freezing chamber for freezing and storing food or beverages as a storeroom, and a refrigerating chamber for storing the food or beverages at a low temperature.

Refrigerators are classified into a top mount type in which a freezing chamber is disposed above a refrigerating chamber, a bottom freezer type in which the freezing chamber is disposed below the refrigerating chamber, and a side-by-side type in which the freezing chamber and the refrigerating chamber are separated as left and right sides. In this case, doors are provided in the freezing chamber and the refrigerating chamber, respectively, and the freezing chamber or the refrigerating chamber are accessed through the doors.

In addition to the refrigerator in which the refrigerating chamber and the freezing chamber are separated from each other, there is also a refrigerator in which the freezing chamber and the refrigerating chamber are accessed through a single door. Most of these refrigerators are small, and a freezing chamber is generally provided in a predetermined space inside the refrigerating chamber.

Among top-mounted refrigerators, a French type refrigerator in which an upper refrigerating chamber is opened and closed through left and right doors is also provided. The freezing chamber of the French type refrigerator is also opened and closed through the left and right doors.

Recently, a home-bar, an ice maker, a shelf, a basket, and the like are mounted on a rear side of a door of a refrigerator, and there is a growing tendency to use the rear side of the door as a separate storage space or a separate function space. That is, the door defines a separate storage space or performs additional functions such as generating and supplying ice or cold water beyond the function of simply opening and closing the freezing chamber or the refrigerating chamber.

A double door refrigerator in which a sub (auxiliary) door is mounted on a main door that opens and closes a storeroom is provided. This is referred to as a door-in-door (DID) refrigerator, that is, a DID refrigerator.

When using such a DID refrigerator, a user uses a storeroom by opening the main door, and uses a sub storeroom by opening only a sub door while the main door is closed.

The sub storage room is provided behind the main door and is referred to as a storage area partitioned from the storage room through some partitions. Recently, there is a trend in that the sub storage area is not formed only in a part of the main door, but is formed in substantially the entire area of the main door.

Therefore, the sub storeroom inside the main door is opened and closed to form a separate door. This is referred to as an interior door. In contrast, the main door described above is referred to as an exterior door.

Baskets for storing food or objects are provided in the main door and the sub door. However, it is difficult to supply cold air to the basket installed in the sub door or the basket installed in the main door.

In addition, there is a problem that the main door itself is too thick, or the door itself including the sub door and the main door takes up an overly large volume, thereby reducing an area of the storeroom of the refrigerator or making the refrigerator excessively large.

For example, the disclosure described in a cited reference (Patent Document 1) below relates to a refrigerator provided with a container in which a storage area (corresponding to a sub storeroom) different from an internal storeroom of the refrigerator is defined on a door side.

In the refrigerator disclosed in Patent Document 1, it is difficult to efficiently supply cold air to a basket installed on a side of an exterior door.

In addition, since the basket installed on the side of the exterior door has a width corresponding to the width of the exterior door, the exterior door becomes too thick in consideration of a storage space of the basket. In this regard, in such a refrigerator, it is difficult to load a lot of food or objects in a basket installed on an exterior door.

In some cases, interference occurs between an inner basket installed in the container and a basket installed in the exterior door.

Even if these baskets are arranged to prevent interference therebetween, a cold air flow path is not efficiently provided or the baskets block cold air, resulting in deterioration in refrigerating efficiency.

The disclosure described in another cited reference (Patent Document 2) below relates to a refrigerator including a container provided on an inner surface of a door, a first hinge member pivotably connecting the door to a cabinet, and a second hinge member pivotably connecting the container to the door.

In the refrigerator disclosed in Patent Document 2, a structure in which the door and the container are independently opened and closed by the first hinge member and the second hinge member is provided.

However, the first hinge member and the second hinge member are spaced apart from each other and formed in complex shapes having various curvatures in order to realize independent opening and closing functions.

Therefore, many manufacturing steps are required to implement the shape of the first hinge member and the second hinge member and a receiving portion for installing the first hinge member and the second hinge member therein. In addition, when these structures are viewed from the outside, the sense of aesthetics of a user is degraded.

There is a need for an efficient installation structure having a simple shape, which does not degrade the sense of aesthetics while independently opening and closing a structure such as a sub door or container defining a sub storage room, which has been gradually used according to the trend, with respect to a door. In addition, there is a structure and shape for which hinge members respectively connected to a door and a sub door are efficiently coupled to each other.

CITED REFERENCE

1. Korean Patent Publication No. 10-2016-0019489 (Released on Feb. 19, 2016)
2. Korean Patent Publication No. 10-2021-0046867 (Released on Apr. 28, 2021).

BRIEF DESCRIPTION OF THE DRAWINGS

The embodiments will be described in detail with reference to the following drawings in which like reference numerals refer to like elements wherein.

DETAILED DESCRIPTION

Reference will now be made in detail to embodiments of the present disclosure, examples of which are illustrated in the accompanying drawings. Wherever possible, the same reference numbers will be used throughout the drawings to refer to the same or like parts, and redundant description thereof will be omitted. As used herein, the suffixes "module" and "unit" are added or used interchangeably to facilitate preparation of this specification and are not intended to suggest distinct meanings or functions. In describing embodiments disclosed in this specification, relevant well-known technologies may not be described in detail in order not to obscure the subject matter of the embodiments disclosed in this specification. In addition, it should be noted that the accompanying drawings are only for easy understanding of the embodiments disclosed in the present specification, and should not be construed as limiting the technical spirit disclosed in the present specification.

Furthermore, although the drawings are separately described for simplicity, embodiments implemented by combining at least two or more drawings are also within the scope of the present disclosure.

In addition, when an element such as a layer, region or module is described as being "on" another element, it is to be understood that the element may be directly on the other element or there may be an intermediate element between them.

Hereinafter, with reference to the accompanying drawings, embodiments of the present disclosure will be described in detail.

Figure 1:
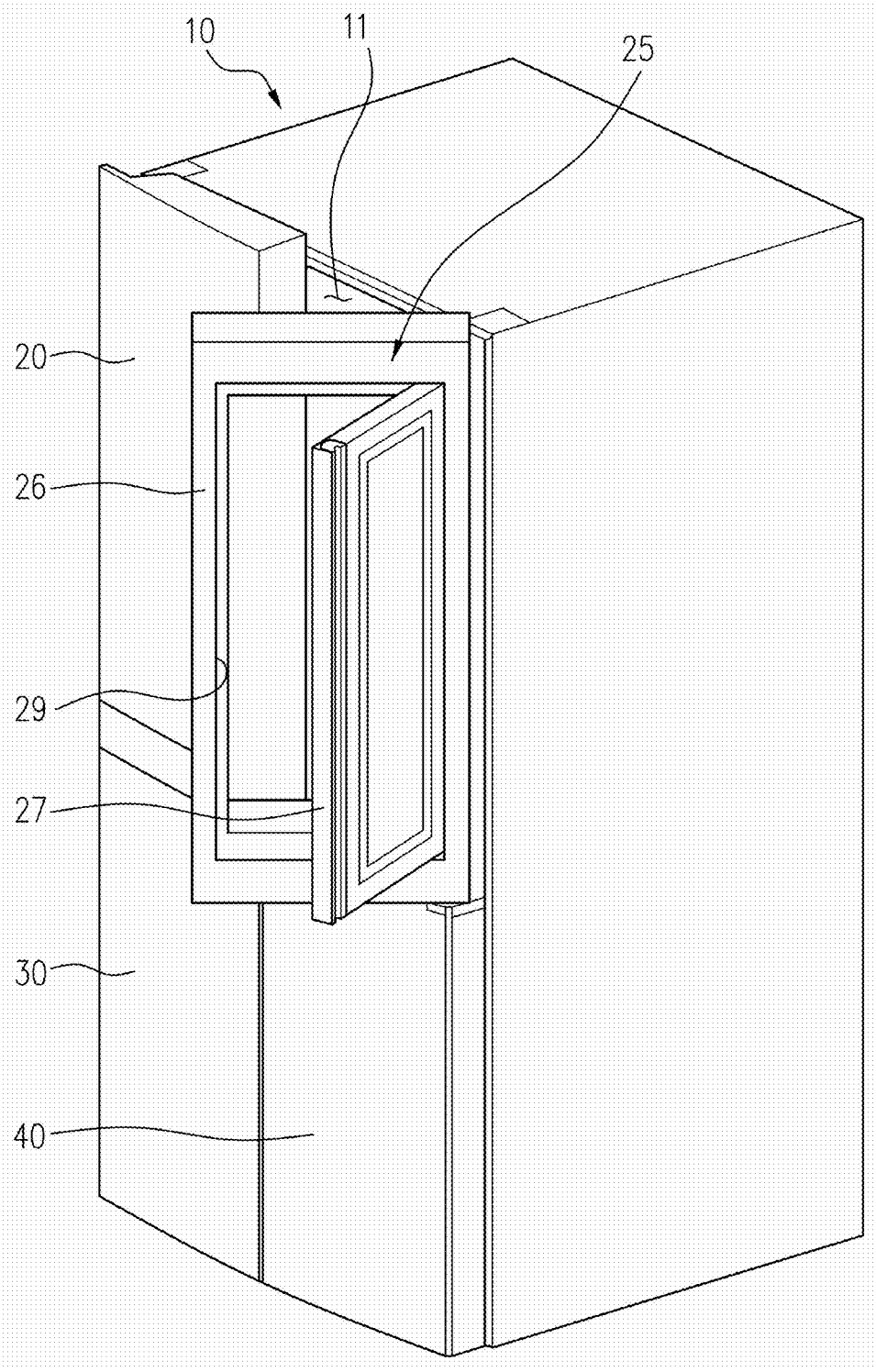
FIG. 1 is a perspective view illustrating a refrigerator applicable to an embodiment of the present disclosure.

FIG. 1 is a perspective view illustrating a refrigerator applicable to an embodiment of the present disclosure. First, a refrigerator applicable to an embodiment of the present disclosure will be described with reference to FIG. 1.

The refrigerator shown in FIG. 1 is a bottom freezer type refrigerator in which a refrigerating chamber is provided as an upper part of a cabinet 10 and a freezing chamber is provided as a lower part of the cabinet 10. The refrigerating chamber and the freezing chamber of the refrigerator may be a part of the storeroom or main storeroom 11 provided inside the cabinet 10.

As described above, the present disclosure is not limited to this type of refrigerator, and the present disclosure may be applied to any refrigerator including a door that is pivotably mounted on a cabinet and opens and closes a storeroom of the refrigerator.

Referring to FIG. 1, as doors for opening and closing the refrigerating chamber, a left refrigerating chamber door 20 and a right refrigerating chamber door 25 may be pivotably installed on left and right sides of the cabinet 10, respectively. Needless to say, unlike this, the refrigerating chamber door may be pivotably mounted one door.

A freezing chamber door provided below a refrigerating chamber door may also include a left freezing chamber door 30 and a right freezing chamber door 40 pivotably mounted on both sides of a front lower part of the cabinet 10, respectively. Unlike this, the freezing chamber door may be one pivotable door or may be a drawer-type door that is retractable and extendable in forward and backward directions.

As shown in FIG. 1, the right refrigerating chamber door 25 may include a main door 26 pivotably mounted on one side of the cabinet 10 and a sub door 27 pivotably mounted with respect to the main door 26 or the cabinet 10. That is, when the main door 26 and the sub door 27 are opened together, the refrigerating chamber (the main storeroom 11) may be accessed.

An opening 29 may be provided inside a central portion of the main door 26, and a sub storeroom (storage space) or a door basket (not shown) may be provided at an inner side (toward the storeroom) of the main door 26.

A pivot direction of the sub door 27 may be the same as that of the main door 26.

As mentioned above, the left refrigerating chamber door 20 and the right refrigerating chamber door 25 may be installed symmetrically on left and right sides of the cabinet 10. At this time, unlike shown in FIG. 1, the left refrigerating chamber door 20 and the right refrigerating chamber door 25 may have the same structure. That is, the left refrigerating chamber door 20 may also have a structure including the main door 26 and the sub door 27 as described above.

Figure 2:
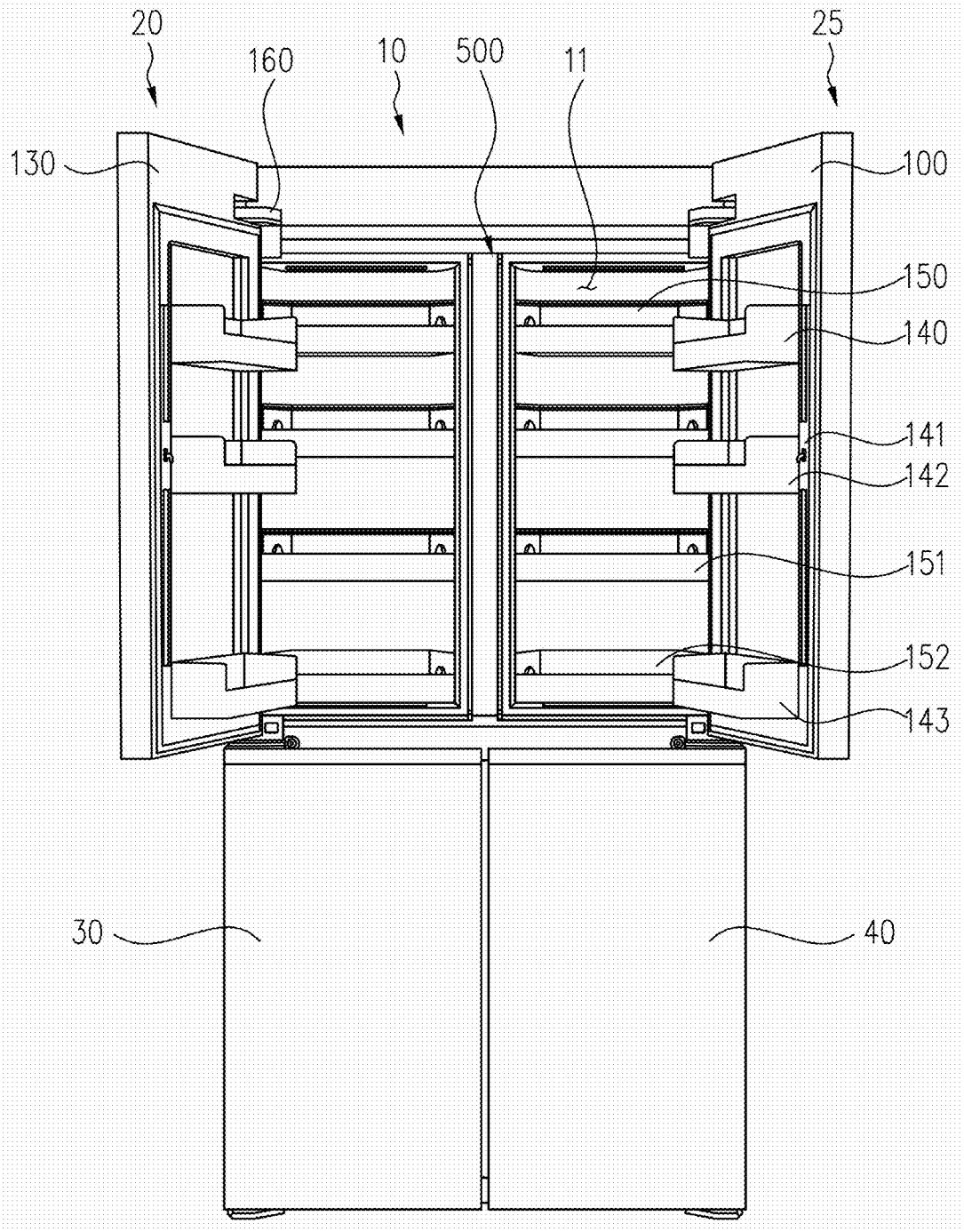
FIG. 2 is a front view illustrating a refrigerator according to an embodiment of the present disclosure.
Figure 3:
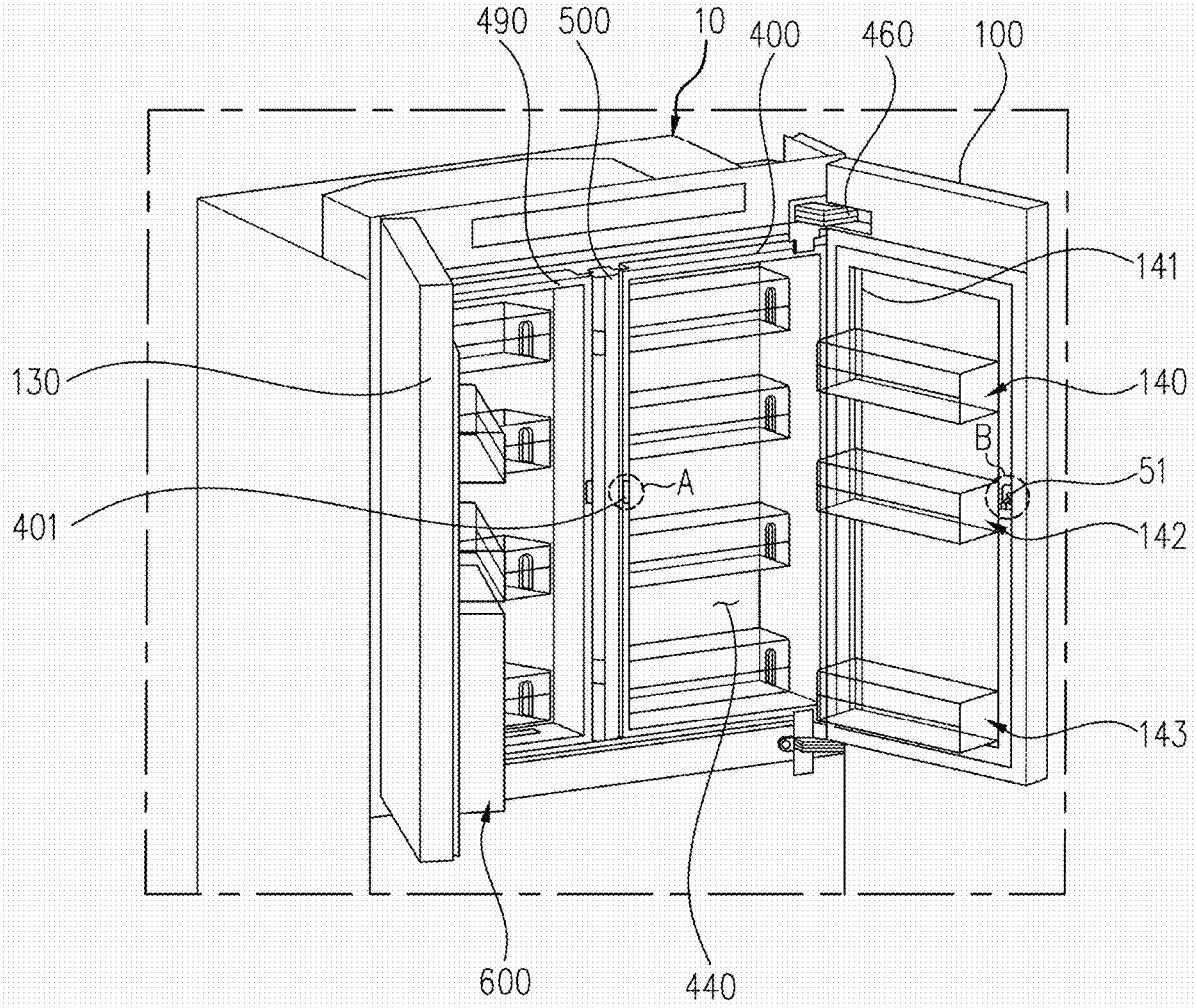
FIG. 3 is a perspective view illustrating a refrigerator according to an embodiment of the present disclosure.
Figure 4:
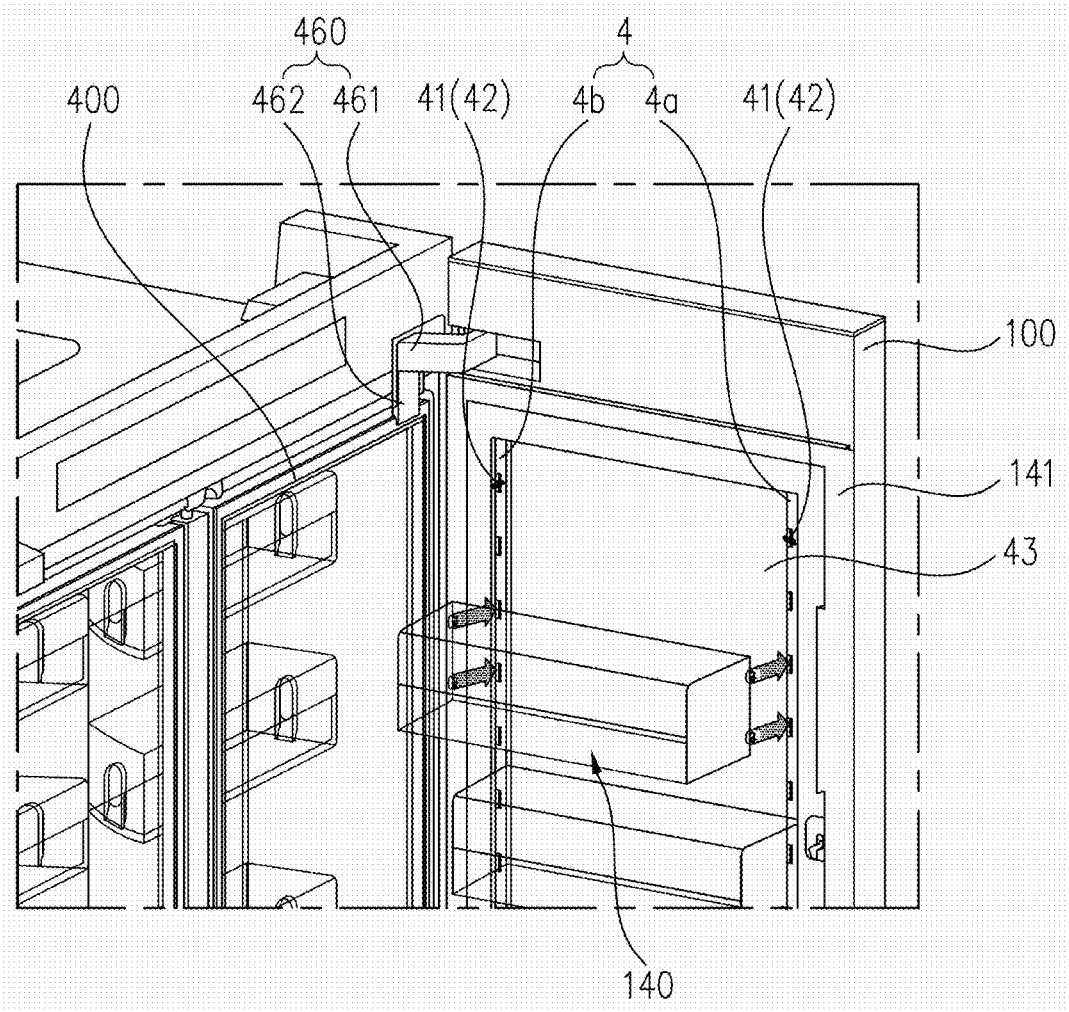
FIG. 4 is an exploded perspective view illustrating a main part of a main door of a refrigerator according to an embodiment of the present disclosure.

FIG. 2 is a front view illustrating a refrigerator according to an embodiment of the present disclosure. FIG. 3 is a perspective view illustrating a refrigerator according to an embodiment of the present disclosure. FIG. 4 is an exploded perspective view illustrating a main part of a main door of a refrigerator according to an embodiment of the present disclosure.

FIGS. 2 and 3 show a state in which the left refrigerating chamber door 20 and the right refrigerating chamber door 25 have symmetrically identical structures and both the left refrigerating chamber door 20 and the right refrigerating chamber door 25 are open.

Description of these doors may be separately applied to the left refrigerating chamber door 20 and the right refrigerating chamber door 25 shown in FIG. 2. In addition, the description of the door may be separately applied to the left freezing chamber door and the right freezing chamber door 40.

A main door frame 141 defining a frame of the main door 100 may be installed in the main door 100, and baskets (main door baskets 140, 142, and 143) for receiving storage items may be accommodated in the main door frame 141.

At this time, referring to FIG. 4, in order to accommodate the main door baskets 140, 142, and 143, guides 4; 4*a*, and 4*b* may be installed on the main door frame 141. The guides 4 may include a first guide 4*a* provided on one side of the main door frame 141 and a second guide 4*b* provided on the other side of the main door frame 141.

More specifically, the first guide 4*a* and the second guide 4*b* may be fixed to both sides of a door recess 43, respectively. The first guide 4*a* may be disposed in a direction away from a hinge part 460, and the second guide 4*b* may be disposed in a direction closer to the hinge part 460.

A plurality of guide fasteners 41 provided along a height direction of the main door 100 may be included on the guides 4. The plurality of guide fasteners 41 may be spaced apart from each other in the height direction.

The main door baskets 140, 142, and 143 may be coupled to these guide fasteners 41. The guide fasteners 41 may be formed as coupling holes 42 penetrating one surface of the guides 4.

In particular, the coupling holes 42 may be formed through one side of the guides 4 facing the main door baskets 140, 142, and 143. Parts of the main door baskets 140, 142, and 143 may be inserted into the coupling holes 42 to be coupled to and supported by the guides 4.

As the coupling holes 42 are provided in a plural number along the height direction, coupling positions of the main door baskets 140, 142, and 143 coupled to and supported by the coupling holes 42 may be freely selected. As the number of the coupling holes 42 is increased, the installation height of the main door baskets 140, 142, and 143 may be more precisely adjusted.

For example, the guide fasteners 41 may be provided in ten or more in the height direction. That is, the coupling holes 42 may be provided in ten or more in the height direction. When the coupling holes 42 are provided in ten, height adjustment of the main door baskets 140, 142, and 143 may also be performed in ten steps. The above number is only a simple example and is not limited thereto.

The coupling holes 42 may be formed to pass through one surface of the guides 4 in a forward and backward direction. This forward and backward direction may mean a forward and backward direction in a state where the main door 100 is closed.

In addition, when the main door baskets 140, 142, and 143 are coupled to the coupling holes 42, the main door baskets 140, 142, and 143 may be coupled in the forward and backward direction in the penetration direction of the coupling holes 42.

As shown in FIG. 4, the right refrigerating chamber door 25 may include the main door 100 pivotably mounted on one side of the cabinet 10 and a sub door 400 pivotably mounted with respect to the main door 100 or the cabinet 10 400. That is, when the main door 100 and the sub door 400 are opened together, the refrigerating chamber (the main storeroom 11) may be accessed.

Referring to FIG. 4, the refrigerator according to an embodiment of the present disclosure may include the hinge part 460 pivotably supporting the right refrigerating chamber door 25 to the cabinet 10. The hinge part 460 may include a first hinge 461 pivotably supporting an exterior door 100 to the cabinet 10. In addition, the hinge part 460 may include a second hinge 462 pivotably supporting the interior door 400 to the cabinet 10 or the exterior door 100.

The first hinge 461 and the second hinge 462 may be provided to be pivoted based on a pivot shaft positioned on the same line. The first hinge 461 and the second hinge 462 may be separately pivotably provided. Also, the second hinge 462 may be disposed inside the first hinge 461.

A pivotable range of the second hinge 462 may depend on an angle of the first hinge 461. For example, when the first hinge 461 is opened by being pivoted by a first angle in a closed state, the second hinge 462 may be separately pivoted within the first angle range in the closed state. When the first hinge 461 is opened by being pivoted by a second angle in the closed state, the second hinge 462 may be separately pivoted within the second angle range in the closed state. That is, pivoting of the second hinge 462 at an angle greater than an opening angle of the first hinge 461 may be restricted.

The hinge part 460 as described above is provided at each of upper and lower portions of the right refrigerating chamber door 25, and may be pivotably support the right refrigerating chamber door 25 to the cabinet 10. The configuration of the hinge part 460 will be described later in detail.

Referring back to FIG. 3, a refrigerator according to an embodiment of the present disclosure may include an accessory part 600 detachably coupled to main doors 100 and 130. The accessory part 600 may be disposed on one surface of a one-side (e.g., left) main door 130, which faces the main storeroom 11.

For example, a user may access the accessory part 600 disposed on one side of the left main door 130 by pivoting and opening the left main door 130.

Referring to FIG. 3, the accessory part 600 is shown in a basket shape for accommodating various storage items such as cans and bottles. However, the present disclosure is not limited thereto, and the accessory part 600 may be provided as a device having various functions. A detailed description thereof will be omitted.

As such, the right refrigerating chamber door 25 may include the main door 100 pivotably coupled to the cabinet 10. In addition, the right refrigerating chamber door may further include the sub door 400 inserted into the cabinet 10.

The sub door 400 may be pivotably coupled to at least one of the main door 100 and the cabinet 10.

The sub door 400 and the main door 100 may be separately pivotably provided. That is, in a state in which the sub door 400 is closed, the sub door 400 does not pivot, and only the main door 100 may be opened by being pivoted. When only the main door 100 is opened, the user may access the sub storeroom (storage space 440).

The sub door 400 and the main door 100 may be detachably coupled to each other. In particular, one side of the sub door 400 and one side of the main door 100, which are positioned in a direction away from a pivot shaft, may be detachably coupled to each other.

When the sub door 400 and the main door 100 are coupled, the sub door 400 and the main door 100 may pivot together, and when the sub door 400 and the main door 100 are separated, only the main door 100 may pivot. Needless to say, even when the sub door 400 and the main door 100 are separated, coupling of one side of the sub door 400 and one side of the main door 100, which are positioned on the pivot shaft, may be maintained.

In a state in which the refrigerating chamber door 25 is closed, the sub door 400 may be pivoted together with the main door 100 to open a storeroom 11. In this regard, a state in which the sub door 400 and the main door 100 integrally pivot will be described later.

Hereinafter, configuration implementing coupling and separation of the sub door 400 and the main door 100 will be briefly described.

The main door 100 may include a latch 51, and the sub door 400 may include a latch insertion hole 401. The latch 51 may be inserted into and coupled to the latch insertion hole 401. In this way, in a state in which engagement between the latch 51 and the latch insertion hole 401 is maintained, the sub door 400 and the main door 100 may be coupled and pivot together. In a state in which engagement between the latch 51 and the latch insertion hole 401 is released, the sub door 400 and the main door 100 are separated and pivot separately.

As such, the sub door 400 may include the latch insertion hole 401 coupled to the latch 51 of the main door 100. The latch insertion hole 401 may be recessed at one side of the sub door 400, which faces the main door 100. The latch 51 provided in the main door 100 may be inserted into the latch insertion hole 401.

Separation of the latch 51 and the latch insertion hole 401 may be implemented through separate manipulation. The latch 51 may be separated from the latch insertion hole 401 through manipulation of a manipulator 532 (refer to FIG. 7) provided separately in the main door 100.

For example, when the main door 100 is opened in a state where a lever is not operated, the sub door 400 may be opened together with the main door 100. In addition, when the main door 100 is opened while the lever is manipulated, the sub door 400 does not move and only the main door 100 may be pivoted and open.

The right refrigerating chamber door 25 and the left refrigerating chamber door 20 may include sub doors 400 and 490, respectively. In this case, a filler 500 may be disposed between the right sub door 400 and the left sub door 490. The filler 500 may prevent cold air of the storeroom 11 from leaking to the outside through a space between the right sub door 400 and the left sub door 490.

Figure 5:
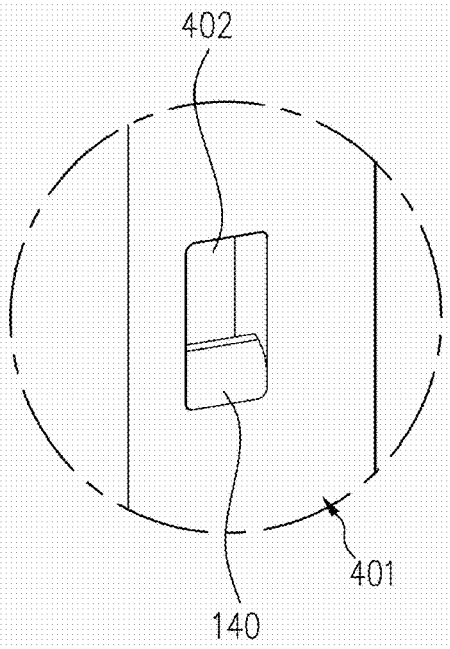
FIG. 5 is an enlarged view of part A of FIG. 3.
Figure 6:
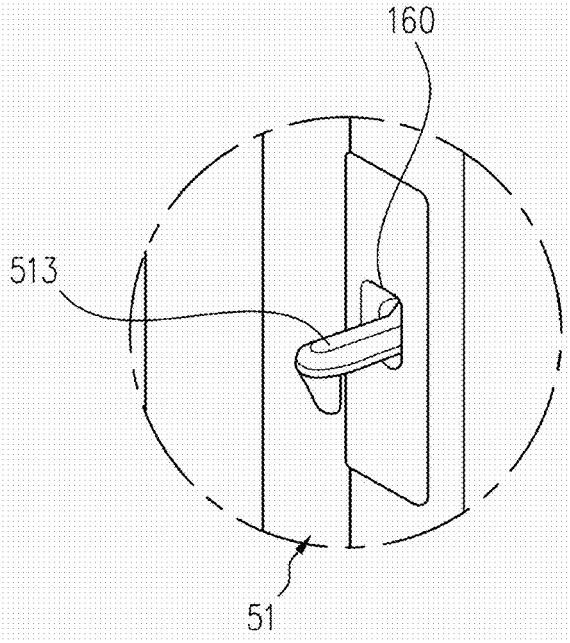
FIG. 6 is an enlarged view of part B of FIG. 3.
Figure 7:
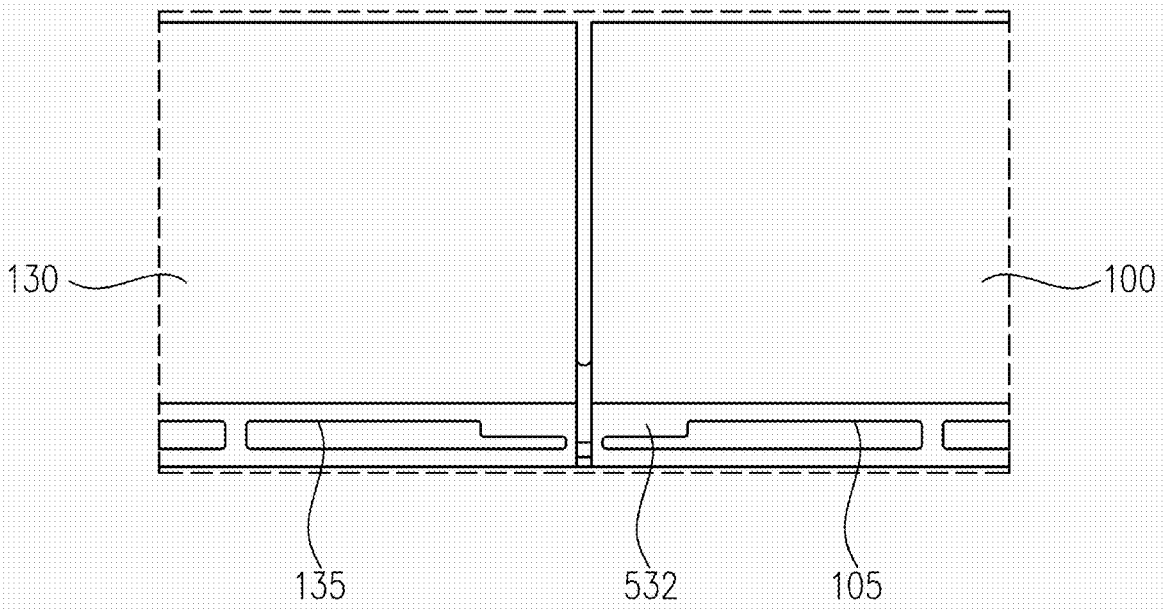
FIG. 7 is a front view showing an example of a manipulator for separating a latch and a latch insertion hole.

FIG. 5 is an enlarged view of part A of FIG. 3. FIG. 6 is an enlarged view of part B of FIG. 3. FIG. 7 is a front view showing an example of a manipulator for separating a latch and a latch insertion hole.

As shown in FIG. 5, the latch insertion hole 401 shown in FIG. 3 may include a restraint protrusion 403 disposed inside an opening 402. As shown in FIG. 6, the latch 51 shown in FIG. 3 may include a catch hook 514 protruding through a cover hole 160.

Due to this configuration, the catch hook 514 may maintain a coupled state between an interior door and an exterior door due to a state of being coupled to the restraint protrusion 403.

The state in which the catch hook 514 and the restraint protrusion 403 are coupled may be released by manipulation of the manipulator 532 to be manipulated by a user.

FIG. 7 shows a state in which the manipulator 532 is exposed and installed on a lower side of the main door 100.

The manipulator 532 may be disposed on one side of a handle part (105 and 135) formed on one side of the main doors 100 and 130. For example, the handle part formed by being recessed from an outer surface of the main doors 100 and 130 at a lower side of the main doors 100 and 130 to allow the user to hold the main doors 100 and 130 may be formed in a horizontal direction. At this time, the manipulator 532 may be disposed on one side of the handle part.

The manipulator 532 may be provided on each of the left main door 130 and the right main door 100. In this case, the manipulator 532 may be symmetrically disposed with respect to a boundary line between the left main door 130 and the right main door 100.

Figure 8:
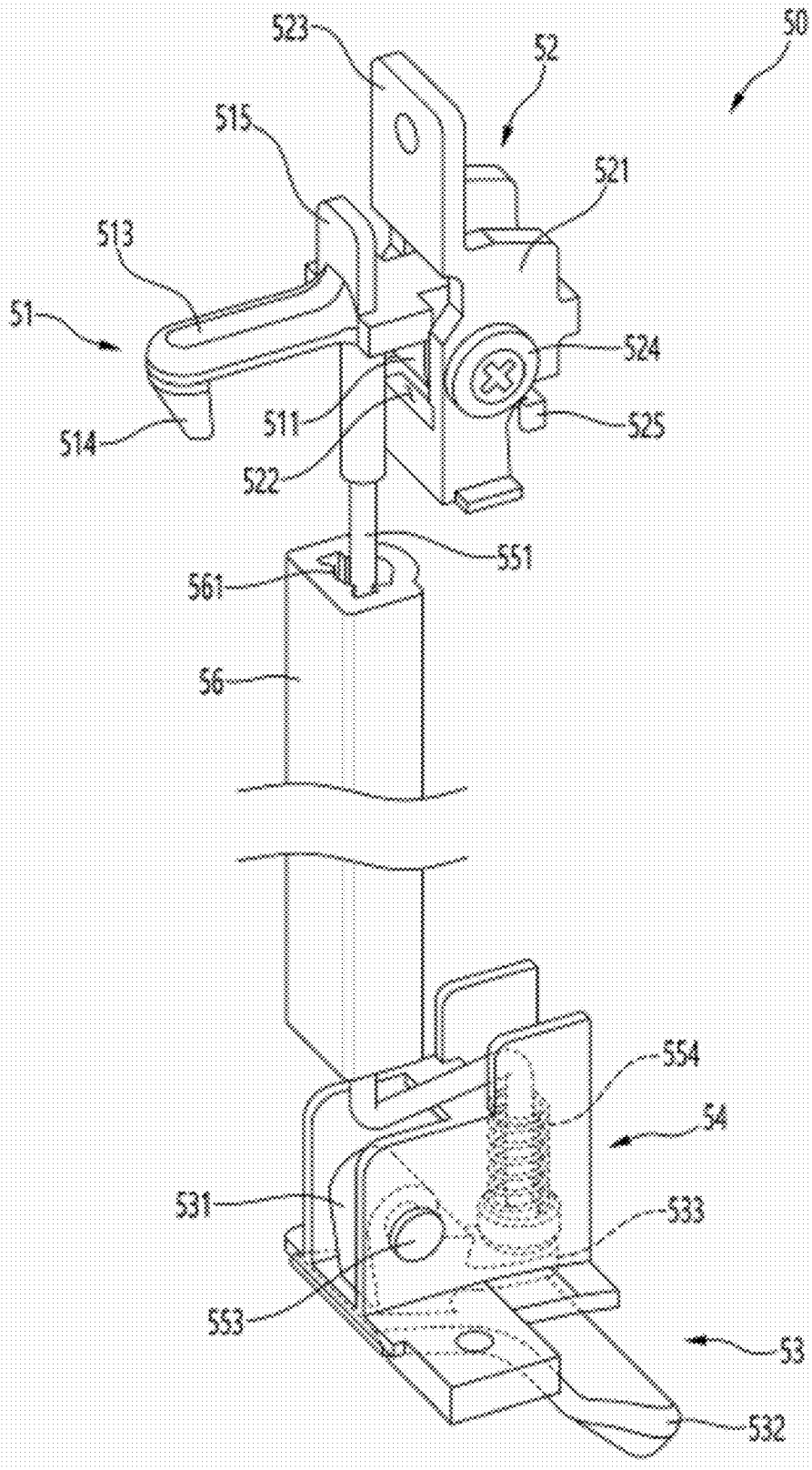
FIG. 8 is a perspective view illustrating an open/close assembly applicable to a refrigerator according to an embodiment of the present disclosure.

FIG. 8 is a perspective view illustrating an open/close assembly applicable to a refrigerator according to an embodiment of the present disclosure.

FIG. 8 shows an example of an open/close assembly 50 in which the catch hook 514 is operated by the manipulator 532. Hereinafter, the configuration of the open/close assembly 50 will be briefly described.

As shown in FIG. 8, the open/close assembly 50 may include the latch 51 that is caught and restrained by a restraint 311 of the main door 100, a manipulation member 53 that is exposed to the outside of the exterior door 100 and is to be manipulated by a user, a connection member 551 connecting the latch 51 and the manipulation member 53 to be operatively associated with each other, and a connection member case 56 accommodating the connection member 551.

The latch 51 may include the latch body 511 accommodated inside the exterior door 100. The latch 51 may be rotated by a rotation shaft 524 installed in a latch body 511 and may be operated in a vertical direction.

In addition, a body extension 513 extending forward from the latch body 511 may be formed, and the body extension 513 may pass through the cover hole 160 and be exposed to the outside.

The catch hook 514 protruding downward may be formed at an end of the body extension 513. The catch hook 514 may be caught and restrained by the restraint protrusion 403 to keep the exterior door 100 in a closed state.

A front stopper 515 protruding upward may be formed on the body extension 513. When the latch 51 rotates to open the main door 100, the front stopper 515 limits a rotation angle to prevent the latch 51 from rotating excessively in a forward direction.

The open/close assembly 50 may include a latch bracket 52 on which the latch 51 is mounted. The latch bracket 52 may be formed such that the latch 51 is rotatably mounted. The latch 51 may be rotatably disposed inside the main door 100 by the latch bracket 52.

The latch bracket 52 may include a bracket body 521 defining a space 522 into which the latch 51 is inserted. A latch rotation shaft 524 may be inserted into the bracket body 521. That is, in a state in which the latch 51 is inserted into the latch bracket 52, the latch rotation shaft 524 may pass through the latch bracket 52 and the latch 51, and thus the latch 51 may be rotatably mounted.

A bracket mounting part 523 extending upward may be formed in the bracket body 521, and a screw hole into which a screw is fastened may be formed in the bracket mounting part 523. The screw may pass through the bracket mounting part 523 and be fastened to the inside of the main door 100.

A bracket side connection part 525 to which an upper end of a spring (not shown) for maintaining a locking state of the latch 51 is coupled may be formed on the bracket body 521. When the latch 51 rotates in a forward direction, a spring is tensioned, and when external force is removed, the latch 51 may rotate in a reverse direction due to elastic force of the spring.

The manipulation member 53 may be provided at a lower end of the open/close assembly 50. The manipulation member 53 may include a rotatably mounted manipulation member body 531, the manipulator 532 that a user presses and manipulates, and a support 533 supporting a lower end of the connection member 551.

The manipulation member body 531 may be rotatably mounted on the manipulation member bracket 54. The manipulator 532 may be formed at a lower end of the manipulation member body 531. The manipulator 532 may extend forward from the manipulation member body 531.

Further, the lower surface of the manipulation member 53 faces downward as going forward, and thus a user may easily rotate the manipulation member 53 by pressing the manipulator 532.

The support 533 extending forward may be formed on the manipulation member body 531. The support 533 may be disposed above the manipulator 532.

The support 533 may extend past the lower end of the connection member 551, and may push up the connection member 551 from below when the manipulation member 53 rotates forward.

As mentioned above, the open/close assembly 50 may include a manipulation member bracket 54 on which the manipulation member 53 is mounted. The manipulation member bracket 54 may be formed to mount the manipulation member 53 rotatably.

In detail, the manipulation member bracket 54 may include the manipulation member body 531 defining a space in which the manipulation member 53 is rotatably mounted. The manipulation member body 531 may be opened downward, and the manipulation member 53 may be inserted and mounted from bottom to top.

The support 533 may be formed on a top surface of the manipulation member body 531. The connection member 533 may support the connection member 551 not to fall. Also, a top surface of a lower spring 554 may be supported on a bottom surface of the connecting member the support 533.

In a state in which the manipulation member 53 is mounted on the manipulation member bracket 54, a remaining part except for the manipulator 532 is accommodated inside the main door 100, and only the manipulator 532 is exposed to the outside to allow the user to manipulate the same.

The connection member 551 may be extended to connect between a restraint member 51 and the manipulation member 53. Accordingly, when the manipulation member 53 is manipulated, the restraint member 51 may be operatively associated with the manipulation member 53 by the connection member 551. The connection member 551 may be formed in the form of a vertically long bar-shaped rod.

A lower cap 553 may be provided at a lower end of the connection member 551. The lower cap 553 may come into contact with the manipulation member 53, prevent noise and impact upon contact, and improve sense of manipulation of the manipulation member 53.

In particular, a bottom surface of the lower cap 553 may be formed in a shape in which a central portion protrudes downward and a circumference is rounded. Accordingly, when the manipulation member 53 is rotated, the bottom surface of the lower cap 553 and the manipulation member the support 533 may be effectively brought into contact.

The connection member case 56 may be formed in a passage or a tube having an accommodation space 561 therein. The connection member case 56 may extend vertically. Also, the connection member case 56 may extend vertically and be shorter than a vertical length of the connection member 551. Accordingly, in a state in which the connection member 551 is inserted into the connection member case 56, upper and lower ends of the connection member 551 may protrude from upper and lower ends of the connection member case 56.

Figure 9:
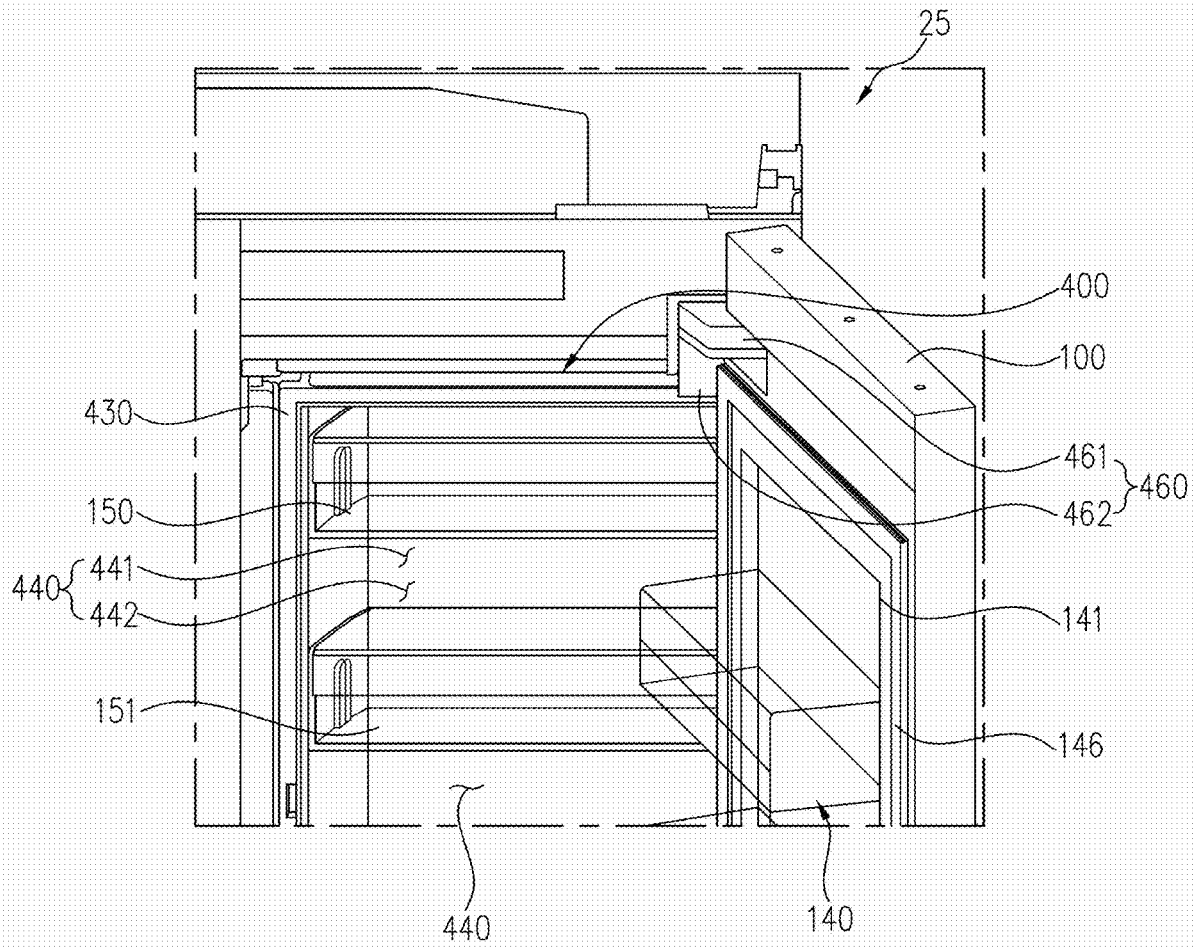
FIGS. 9 and 10 are perspective diagrams illustrating a right refrigerating chamber door of a refrigerator applicable to an embodiment of the present disclosure.
Figure 10:
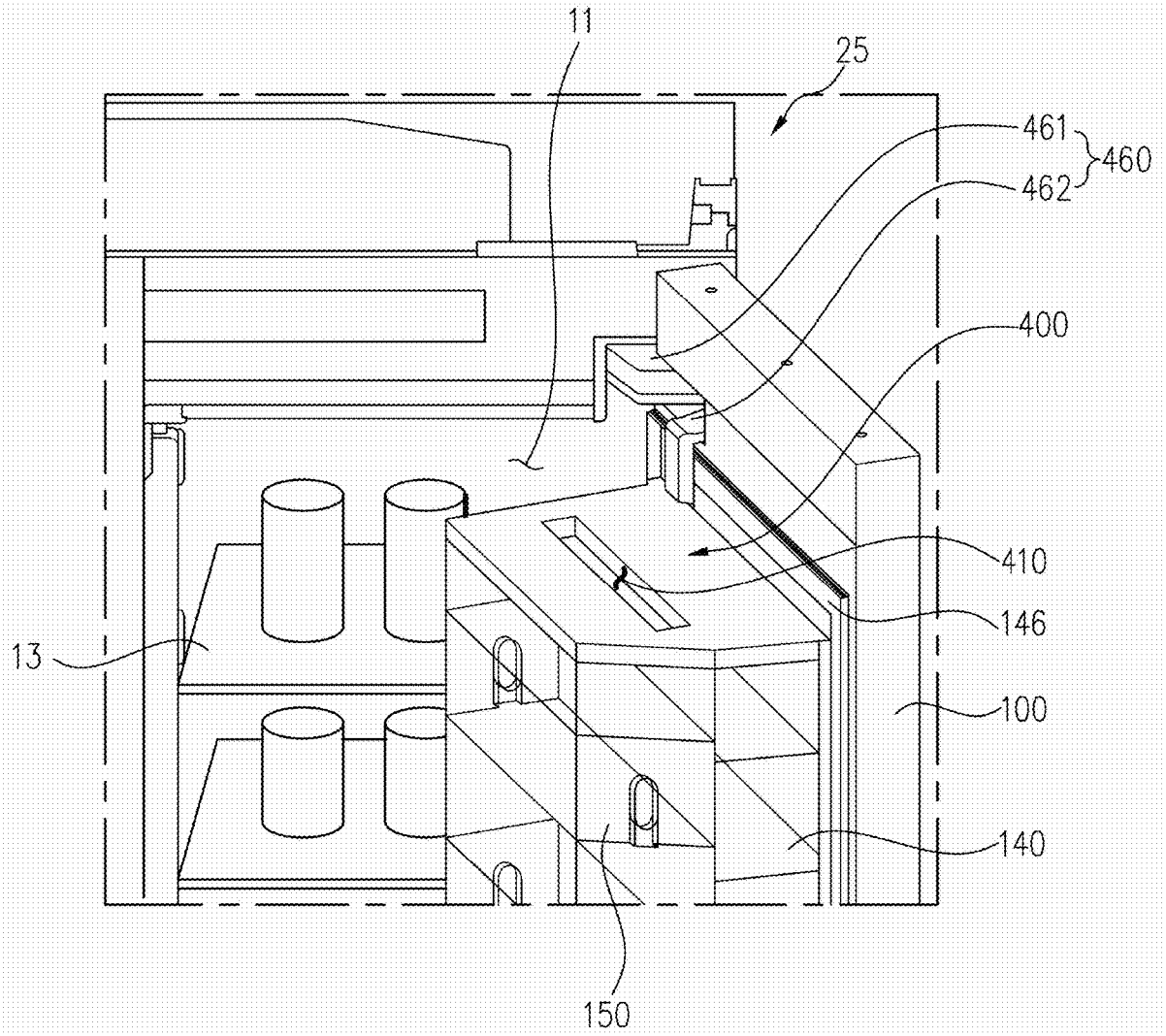

FIGS. 9 and 10 are perspective diagrams illustrating a right refrigerating chamber door of a refrigerator applicable to an embodiment of the present disclosure.

FIG. 9 shows a state in which the main door 100 in the right refrigerating chamber door 25 is opened, and FIG. 10 shows a state in which the main door 100 and the sub door 400 in the right refrigerating chamber door 25 are both opened.

Hereinafter, detailed configurations of the main door 100 and the sub door 400 will be described in detail with reference to FIGS. 9 and 10.

As described above, the description of the door may be applied in the same way to all doors (left/right refrigeration/freezing chamber doors). For example, the description below may be applied in the same way to the left refrigerating chamber door 20.

Referring to FIGS. 9 and 10, the right refrigerating chamber door 25 may include the main door 100 and the sub door 400. The main door 100 may be pivotably coupled with respect to the cabinet 10. When the main door 100 is opened, the user may access the sub storeroom (storage space 440) formed in the sub door 400.

The main door 100 disposed outside the sub door 400 may also be referred to as the exterior door 100. That is, when the sub door 400 is provided, the main door 100 combined with the sub door 400 may be referred to as an exterior door. Also, the sub door 400 may be referred to as an interior door. Hereinafter, the term the main door 100 may be used interchangeably with the term exterior door. Likewise, the term the sub door 400 may be used interchangeably with the term interior door.

The sub door 400 may include the storage space 440. One side of the storage space 440 may be opened. For example, the storage space 440 may be opened in a direction toward the main door 100. Specifically, a surface of the storage space 440, which faces the main door 100, may be opened.

The storage space 440 may be formed by an accommodation part 430. That is, the storage space 440 may be formed by the accommodation part 430 having a container shape with at least one surface open.

Inside the storage space 440 formed by the accommodation part 430, interior door baskets 150 and 151 may be installed.

In this case, the main door baskets 140, 142, and 143 and the interior door baskets 150, 151, and 152 may be provided not to overlap each other. More specifically, the main door baskets 140, 142, and 143 and the interior door baskets 150, 151, and 152 may be provided not to overlap each other in a horizontal direction.

Also, the storage space 440 may include a first region 441 facing the storeroom 11 and a second region 442 toward the outside. That is, the storage space 440 may include the first region 441 formed inwardly in a depth direction of the cabinet 10 and the second region 442 disposed outside the first region 441.

Sub door baskets 150 and 151 may be installed in the first region 441. In addition, at least a part of the main door basket 140 may be positioned in the second region when the main door 100 is closed. Accordingly, the sub door 400 including the sub door baskets 150 and 151 and the main door 100 including the main door basket 140 are combined to form the efficient storage space 440 without interfering with each other.

As described above, the sub door 400 may form the storage space 440 having a width between a first surface toward the storeroom 11 and a second surface toward the main door 100. The storage space 440 may be formed by the accommodation part 430 having an approximate container shape.

The storage space 440 of the sub door 400 may have a predetermined width from a front surface of the cabinet 10 to a depth direction of the cabinet 10.

In this case, the sub door baskets 150 and 151 may be positioned within the storage space 440 and spaced apart from the front surface of the cabinet 10. That is, since the sub door baskets 150 and 151 are positioned in the first region 441, the sub door baskets 150 and 151 may be spaced apart from the open surface of the storage space 440 by a predetermined distance.

At this time, the sub door baskets 150 and 151 may be installed over a certain width in at least a portion of the storage space 440. In other words, the sub door baskets 150 and 151 may have a width corresponding to the first region 441. Also, at least a part of the main door basket 140 may be positioned in the second region 442 when the main door 100 is closed. The storage space 440 including the first region 441 and the second region 442 will be described later in detail.

When the sub door 400 is closed, the storage space 440 formed by the accommodation part 430 of the sub door 400 may be inserted and positioned inside the storeroom 11. In this case, both the first region 441 and the second region 442 may be inserted and positioned inside the storeroom 11.

Due to this, the sub door 400 including the sub door baskets 150 and 151 and the main door 100 including the main door basket 140 are combined to form the efficient storage space 440 without interfering with each other. Accordingly, the amount of load to be accommodated compared to the same volume may be increased. In addition, since at least a part of the main door basket 140 is positioned within the storage space 440, cold air may be efficiently supplied to the main door basket 140. Also, fluidity of air flowing through the main door basket 140 and the sub door baskets 150 and 151 may be increased. In addition, the overall thickness of the door may be reduced.

In some cases, the first region 441 may be inserted and positioned inside the storeroom 11, a part of the second region 442 may be inserted and positioned inside the storeroom 11, and the remaining part of the second region 442 may be positioned outside the storeroom 11.

As such, the sub door 400 forms the storage space 440 positioned inside the storeroom 11 in a closed state, and at least a part of the main door basket 140 may be positioned in the storage space 440.

FIG. 9 shows a state in which the sub door 400 is closed without pivoting with the main door 100. FIG. 10 shows a state in which the sub door 400 pivots with the main door 100 and is open.

Referring to FIG. 9, the main door 100 may include a door gasket 146 to prevent leakage of cold air inside the storeroom 11. For example, the door gasket 146 may be disposed between an inner surface of the main door 100 and the cabinet 10 in a closed state of the main door 100 to prevent cold air in the storeroom 11 from leaking. The door gasket 146 may be provided along a circumference of the main door frame 141.

Referring to FIG. 10, in a state in which the sub door 400 pivots with the main door 100 and is open, the main storeroom 11 may be exposed.

A shelf 13 (or a storage box) may be provided inside the main storeroom 11. The shelf 13 may partition the inside of the storeroom 11. The shelf 13 may improve space utilization of the main storeroom 11 by partitioning the inside of the main storeroom 11 in a height direction.

Referring to FIG. 10, an inflow path 410 of cold air penetrating one side surface (e.g., top surface) of the sub door 400 may be formed in the sub door 400. For example, the inflow path 410 may be positioned to allow cold air inside the storeroom 11 to be introduced. As another example, the inflow path 410 may be connected to a cold air outlet (not shown) through which cold air is supplied through a separate cold air supply (not shown).

Although not shown in FIG. 10, an outflow path 420 (refer to FIG. 12) through which cold air is discharged may be formed on the other side surface (e.g., a bottom surface) of the sub door 400. The inflow path 410 and the outflow path 420 as described above may form a flow path through which cold air is circulated through the storage space 440.

Referring to FIG. 10, in a state in which the sub door 400 and the main door 100 are coupled (for example, by coupling the latch 51 and the latch insertion hole 401), the storage space 440 of the sub door 400 includes the sub door basket 150 and the main basket 140 that are disposed together. Therefore, cold air may be efficiently supplied to the main door basket 140 through the storage space 440.

As mentioned above, in the storage space 440 of the sub door 400, a part in which the sub door basket 150 is disposed may correspond to the first region 441, and a part in which the main door basket 140 is disposed may correspond to the second region 442.

At this time, for efficient flow and circulation of cold air, the position of the sub door basket 150 installed at the uppermost part of the sub door 400 is provided higher than the position of the main door basket 140 installed at the uppermost part of an inner surface (at a side of the storeroom) of the main door. Therefore, cold air introduced through the inflow path 420 is first supplied to the sub door basket 150 adjacent to the inflow path 420, and then may flow toward the main door basket 140.

In addition, referring to FIG. 10, the main storeroom 11 formed in the cabinet 10 may be seen in a state in which both the left refrigerating chamber door 20 and the right refrigerating chamber door 25 are open (the state of FIG. 2 indicates a state in which the sub door 400 is closed state, in this case, the main storeroom 11 may be seen through the sub door 400).

Figure 11:
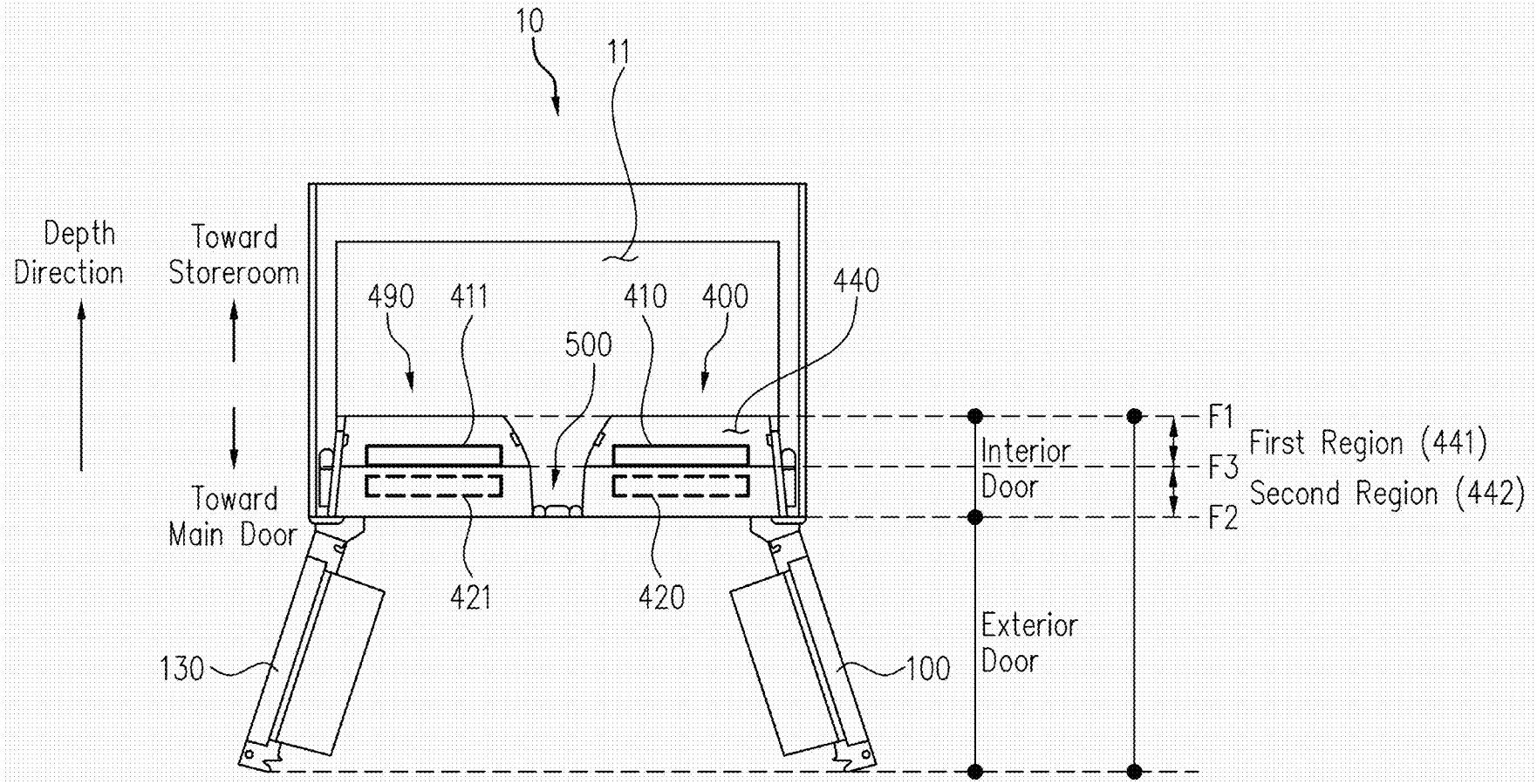
FIGS. 11 and 12 are schematic diagrams illustrating relative positions of a main door and a sub door of a refrigerator with respect to a cabinet according to an embodiment of the present disclosure.
Figure 12:
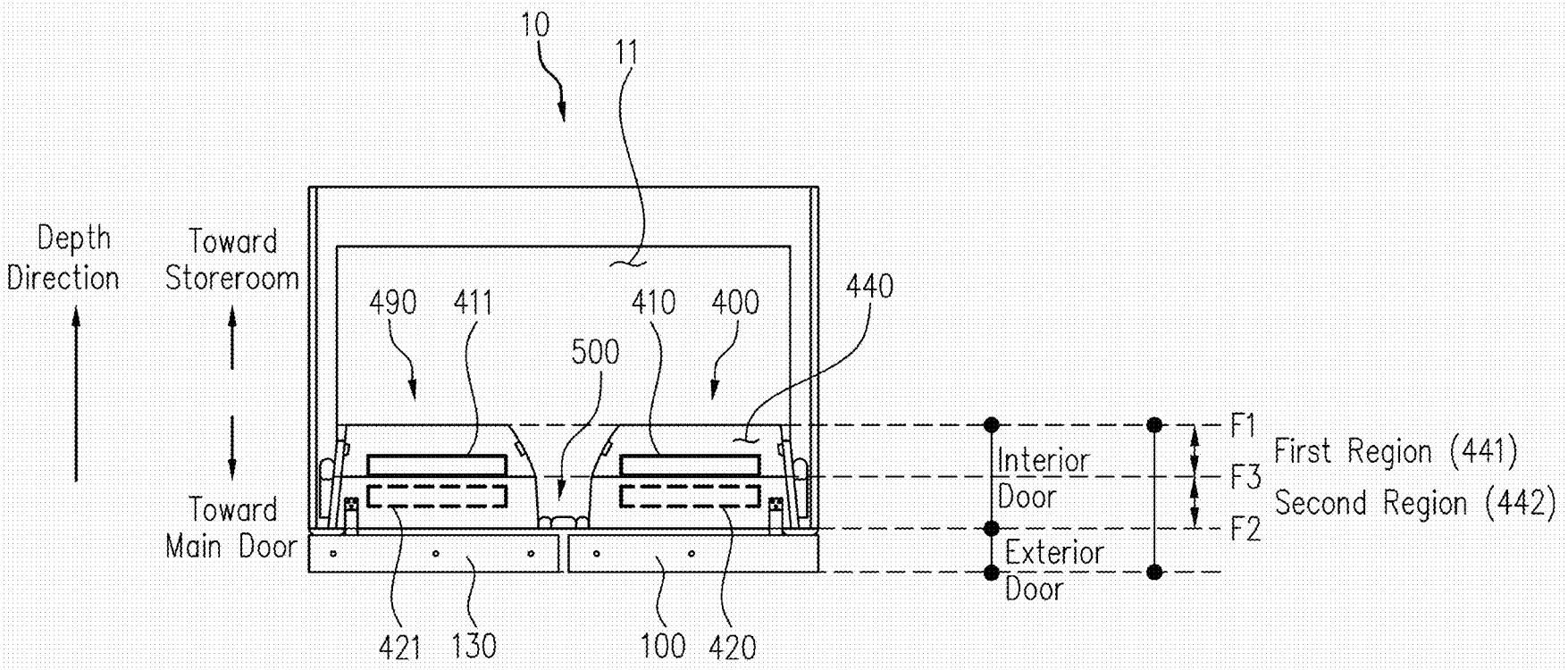

FIGS. 11 and 12 are schematic diagrams illustrating relative positions of a main door and a sub door of a refrigerator with respect to a cabinet according to an embodiment of the present disclosure.

FIG. 11 shows a state in which the sub doors 400 and 490 are closed and the main doors 100 and 130 are open, and FIG. 12 shows a state in which both the sub doors 400 and 490 and the main doors 100 and 130 are closed.

First, referring to FIG. 11, an area occupied by the sub doors 400 and 490 may be inserted and positioned in a depth direction of the storeroom 11. That is, when the sub doors 400 and 490 are closed, the first region 441 and the second region 442 occupied by the sub doors 400 and 490 may be positioned inside a space of the storeroom 11 defined by the cabinet 10.

In this case, the area occupied by the sub doors 400 and 490 may be formed from a first side F1 to a second side F2 based on the depth direction of the storeroom 11. In addition, the first region 441 may have a width between the first side F1 and a third side F3 positioned between the first side F1 and the second side F2. The second region 442 may have a width between the second side F2 and the third side F3.

As shown in FIGS. 11 and 12, the first side F1 may mean the deepest position in the depth direction of the storeroom 11. On the other hand, the second side F2 may mean the outermost position in the depth direction of the storeroom 11. For example, the second side F2 may be a position at which an open surface of the storage space 440 formed by the accommodation part 430 is positioned.

In this case, the sub door baskets 150, 151, and 152 may be installed across the third side F3, which is spaced apart from the second side F2 by the second region 442, from the first side F1. In other words, a width extending from the first side F1 to the third side F3 may correspond to the first region 441. A width from the third side F3 to the second side F2 may correspond to the second region 442.

In this case, the inflow paths 410 and 411 may be positioned in the first region 441, that is, a region between the first side F1 and the third side F3. The outflow paths 420 and 421 may be positioned in the second region 442, that is, a region between the second side F2 and the third side F3.

The filler 500 is disposed between the two sub doors 400 and 490 to control cold air inside the storeroom 11.

As seen from FIG. 12, in a state in which the main doors 100 and 130 are closed, a thickness occupied by the main doors 100 and 130 does not substantially penetrate the storage space 440 (the first region 441+the second region 442). Accordingly, the thickness of the main doors 100 and 130 may be reduced. Therefore, a portion unnecessarily occupied by the main doors 100 and 130 in the overall volume of the refrigerator may be reduced. That is, the volume usage efficiency of the entire refrigerator may be increased.

This is because the main door baskets 140, 142, and 143 installed on the main doors 100 and 130 are substantially disposed inside the storage space 440 inside the sub doors 400 and 490.

Figure 13:
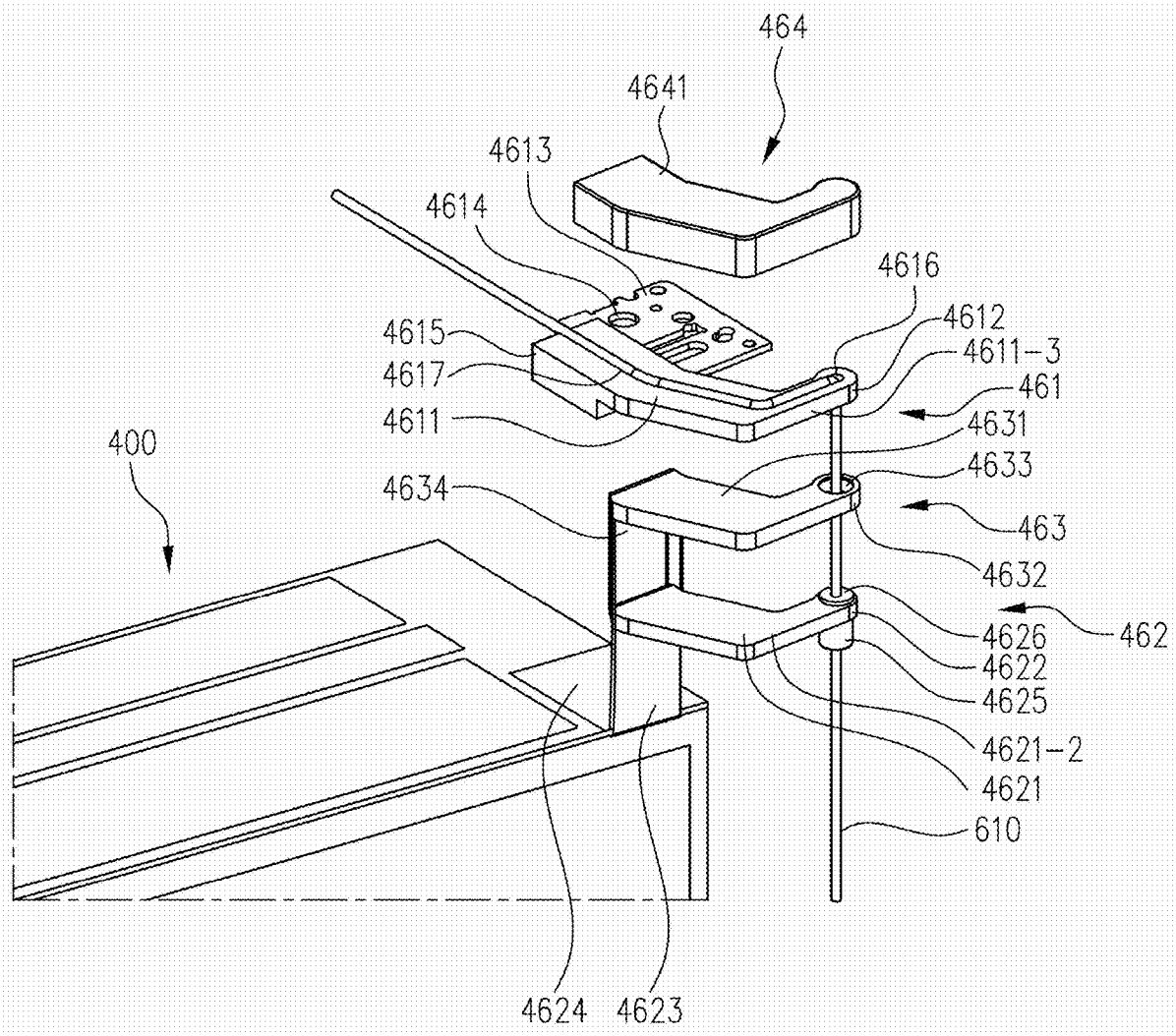
FIG. 13 is an exploded perspective view showing a main configuration of a hinge part of a refrigerator according to an embodiment of the present disclosure.

FIG. 13 is an exploded perspective view showing a main configuration of a hinge part of a refrigerator according to an embodiment of the present disclosure.

As described above, the refrigerator according to an embodiment of the present disclosure may include the hinge part 460 pivotably supporting the refrigerating chamber door 25 to the cabinet 10. The hinge part 460 may include the first hinge 461 pivotably supporting the main door 100 to the cabinet 10. The hinge part 460 may include the second hinge 462 pivotably supporting the sub door 400 to the cabinet 10 or the main door 100.

The main door 100 may be pivotably provided to the cabinet 10 by the first hinge 461 to open and close a storeroom. In addition, the sub door 400 is disposed inside the cabinet 10 and is rotatably provided with respect to the main door 100 by the second hinge 462, and includes the accommodation part 430 defining the storage space 440 disposed inside the storeroom 11 in a closed state.

Referring to FIG. 13, the first hinge 461 includes a first body (or first plate) 4611 connected between the cabinet 10 and the main door 100 and a first pivot hole 4616 installed in a pivot shaft 465 (refer to FIG. 15) positioned at a side of the main door 100. Here, reference may be made to FIGS. 3 and 4 for relative positions of the cabinet 10 and the hinge part 460.

In addition, the second hinge 462 may include a second body (or second plate) 4621 connected between the main door 100 and the sub door 400 and a second pivot hole 4622 positioned on a side of the main door 100 and installed in the pivot shaft 465.

The pivot shaft 465, in which the first hinge 461 and the second hinge 462 are coaxially connected and pivoted, may be vertically installed on one side of the main door 100. The pivot shaft 465 may be a pivot shaft having a hole formed therein in a longitudinal direction.

FIG. 13 shows an example in which a conducting wire 610 is installed through the first pivot hole 4616 and the second pivot hole 4622. In this example, the conducting wire 610 may be installed in a hole inside the pivot shaft 465. That is, the pivot shaft 465 surrounding the conducting wire 610 in FIG. 13 is omitted. Hereinafter, the rotating shaft and the pivot shaft will be described using the same reference numeral 465.

In this case, in a state in which the sub door 400 is closed, the first body 4611 and the second body 4621 may be disposed parallel to each other. In other words, in a state in which the sub door 400 is closed, the first body 4611 and the second body 4621 may be disposed to overlap each other.

Here, the state in which the sub door 400 is closed may mean a state in which the storage space 440 of the sub door 400 is positioned in the storeroom 11 as shown in FIG. 9. FIGS. 11 and 12 described above also show a state in which the sub door (interior door) 400 is closed.

In this way, in a state in which the sub door 400 is closed, the first body 4611 and the second body 4621 may be disposed parallel to each other or overlap each other. At this time, the position of the main door 100 may be independent of a coupling state of the first hinge 461 and the second hinge 462. For example, when the sub door 400 is in a closed state, the first body 4611 and the second body 4621 may be disposed parallel to each other or overlap each other while the main door 100 is in an open or closed state.

Specifically, the first body 4611 and the second body 4621 may overlap each other in a vertical direction.

As shown, the first body 4611 and the second body 4621 may have a flat plate shape. When main planes of the first body 4611 and the second body 4621 having such a flat plate shape are referred to as a first plane and a second plane, respectively, in a state in which the sub door 400 and the main door 100 are coupled to each other, the first plane and the second planes may be positioned parallel to each other, and the first plane and the second plane may overlap each other.

In this case, outlines of the first body 4611 and the second body 4621 may overlap each other. Therefore, the first hinge 461 and the second hinge 462 may improve aesthetics along with functional simplicity.

In a state in which the sub door 400 is open, the first body 4611 and the second body 4621 may be disposed in a state of being pivoted at different angles with respect to the pivot shaft 465. That is, when the sub door 400 is open, the first body 4611 and the second body 4621 may not overlap each other (refer to FIGS. 10 and 20). Accordingly, even when the sub door 400 is coupled to the main door 100 and opened, the first body 4611 and the second body 4621 may not overlap each other.

According to an exemplary embodiment, the first body 4611 includes a first bent portion (or first extension) 4611-3 bent in a direction perpendicular to a pivot shaft of the first hinge 461, and the second body 4621 includes a second bent portion (or second extension) 4621-2 bent in a direction perpendicular to a pivot shaft of the second hinge 462.

In this case, in a state in which the sub door 400 is closed, the first bent portion 4611-3 and the second bent portion 4621-2 may be provided in parallel with each other. In other words, in a state in which the sub door 400 is closed, the first bent portion 4611-3 and the second bent portion 4621-2 may be disposed to overlap each other in a vertical direction.

At this time, like the first body 4611 and the second body 4621, outlines of the first bent portion 4611-3 and the second bent portion 4621-2 may overlap each other. Therefore, the first hinge 461 and the second hinge 462 can improve aesthetics along with functional simplicity.

The first bent portion 4611-3 is bent at a first angle R2 (refer to FIG. 14) with respect to the first body 4611, and the second bent portion 4621-2 is bent with a second angle R3 (refer to FIG. 14) with respect to the second body 4621. Here, the first pivot hole 4616 may be disposed at an end 4612 of the first bent portion 4611-3.

According to an exemplary embodiment, the first hinge 461 may include a first fixing piece (or first fixing plate) 4613 connected to the first body 4611 and fixed to the cabinet 10. A fixing hole 4614 is formed in the first fixing piece 4613 such that a fastener such as a bolt is fixed to the cabinet 10 through the fixing hole 4614.

Here, the first body 4611 and the first fixing piece 4613 may have a height difference. Referring to FIG. 13, a stepped part 4615 in which the first fixing piece 4613 of the first body 4611 is disposed is formed to have a predetermined thickness (step difference), and thus the first body 4611 and the first fixing piece 4613 have a height difference.

The second hinge 462 may include a second fixing piece (or second fixing plate) 4624 connected to the second body 4621 and fixed to the sub door 400. The second fixing piece 4624 may be fixed to a top surface of the sub door 400. That is, as shown in FIG. 13, the second fixing piece 4624 may be fixed to an edge side of the top surface of the sub door 400. Similar to the first fixing piece 4613, a fixing hole is formed in the second fixing piece 4624 such that a fastener such as a bolt is fixed to the top surface of the sub door 400 through the fixing hole (refer to FIG. 16).

At this time, the second body 4621 and the second fixing piece 4624 may be connected to each other with a height step difference by a vertical extension 4623.

As described above, in a state in which the sub door 400 is closed, the first body 4611 and the second body 4621 may be disposed to overlap each other. In this case, the first body 4611 and the second body 4621 may be disposed to substantially contact each other. Here, the meaning of substantial contacting may mean that rotation is possible in a contact state except for a device for facilitating smooth rotation between the first body 4611 and the second body 4621 or between the first hinge 461 and the second hinge 462.

According to an exemplary embodiment, the first hinge 461 and the second hinge 462 may mutually rotate while maintaining a distance for mutual rotation of the first hinge 461 and the second hinge 462 by a spacer 4626. In other words, the spacer 4626 may function as a bearing between the first hinge 461 and the second hinge 462. More specifically, the spacer 4626 may maintain a space between the first body 4611 and the second body 4621 for rotation.

The spacer 4626 may be provided between the first pivot hole 4616 and the second pivot hole 4622. That is, the spacer 4626 may be provided between the first pivot hole 4616 and the second pivot hole 4622. The spacer 4626 may be inserted into at least one of the first pivot hole 4616 and the second pivot hole 4622. FIG. 13 shows a state in which the spacer 4626 is inserted and positioned inside the second pivot hole 4622. However, the present disclosure is not limited thereto.

In this way, in a state in which the main door 100 is closed or in a state in which the main door 100 and the sub door 400 are coupled to each other, the first hinge 461 and the second hinge 462 maintain a distance for mutual rotation by the spacer 4626 and overlap each other.

Accordingly, the second body 4621 and the second fixing piece 4624 of the second hinge 462 may be connected to each other with a height step difference by the vertical extension 4623. In other words, when the first body 4611 and the second body 4621 of the first hinge 461 and the second hinge 462 substantially overlap each other, the vertical extension 4623 has a height corresponding to a height difference between parts in which the first hinge 461 and the second hinge 462 are respectively installed. Specifically, the vertical extension 4623 may have a height corresponding to a height difference between a top surface of the sub door 400 and a portion of the cabinet 10 to which the first hinge 461 is fixed.

According to an exemplary embodiment, the first body 4611 of the first hinge 461 may be provided with a conducting wire groove 4617 in which the conducting wire 610 is installed. The conducting wire 610 may be installed through the first pivot hole 4616 of the first hinge 461. Accordingly, the first pivot hole 4616 may be connected to the conducting wire groove 4617.

The conducting wire 610 may extend from the first body 4611 of the first hinge 461 to the first bent portion 4611-3. The conducting wire 610 may be installed in the main door 100 together with the pivot shaft 465. For example, a portion of the conducting wire 610 shown below the first pivot hole 4616 in FIG. 13 may be disposed within the main door 100 while being disposed within the pivot shaft 465 (refer to FIG. 15). The conducting wire 610 may supply power necessary for the main door 100. For example, the conducting wire 610 may supply power necessary for at least one of a lighting, a display, and the accessory part 600 of the main door 100.

The first hinge 461 may further include a first cover 464 covering the first body 4611 and the first bent portion 4611-3. The first cover 464 may cover the conducting wire groove 4617 in which the conducting wire 610 is installed.

The first cover 464 may have the same shape as the first hinge 461 except for the first fixing piece 4613. That is, the first cover 464 may cover the rest of the first hinge 461 except for the first fixing piece 4613.

Accordingly, the first cover 464 may have the same shape as the rest of the first hinge 461 except for the first fixing piece 4613. That is, the first cover 464 may have a shape corresponding to the first body 4611 and the first bent portion 4611-3 of the first hinge 461.

The first cover 464 includes a top surface (fourth body) 4641 covering the first hinge 461. A side surface extending from the top surface 4641 contacts an external shape of the first hinge 461, and thus the first cover 464 may be integrally provided with the first hinge 461 (refer to FIG. 15).

Referring to FIG. 13, a second cover 463 may be disposed on the second hinge 462. The second cover 463 may have substantially the same shape as the second hinge 462. Therefore, in some cases, the second cover 463 may be omitted.

Since the second cover 463 has the same shape when overlapping the second hinge 462, the second cover 463 may serve to reinforce the thickness of the second hinge 462.

The second cover 463 may have a third body 4631 and a third bent portion 4632. The second cover 463 may have a third pivot hole 4633 at an end side of the third bent portion 4632.

In addition, the second cover 463 may include a coupler 4634 bent in a vertical direction from the third body 4631. The coupler 4634 may overlap and combine with the vertical extension 4623 of the second hinge 462. That is, the coupler 4634 may be a part in which the second hinge 462 and the second cover 463 are coupled to each other. In this state, the second cover 463 may contact and be coupled to the second hinge 462.

A shaft extension 4625 extending in a direction of the pivot shaft 465 may be provided in the second pivot hole 4622 of the second hinge 462. The shaft extension 4625 may increase a combined area with the pivot shaft 465, and thus the second hinge 462 may be stably supported by the pivot shaft 465 by the shaft extension 4625.

Figure 14:
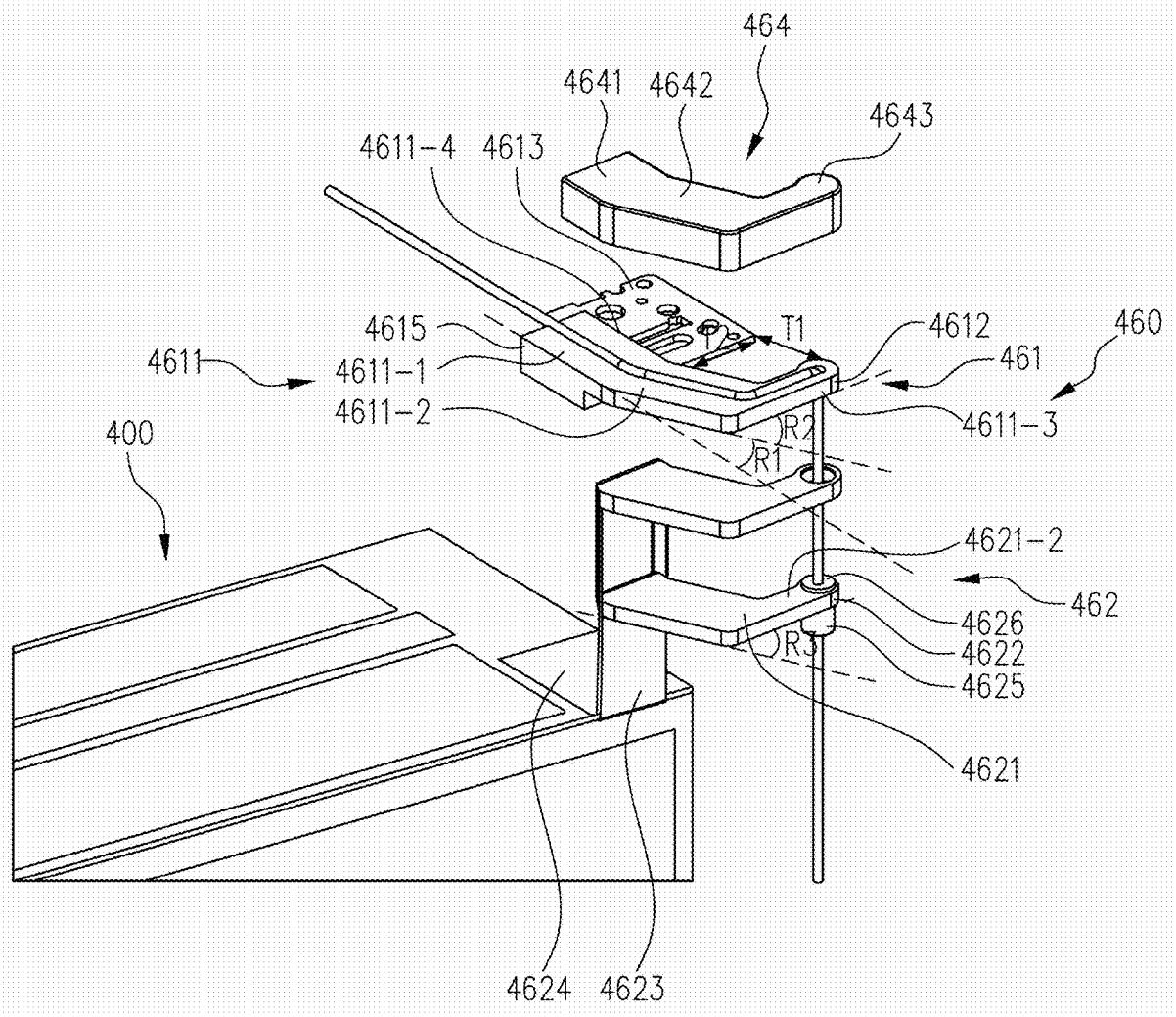
FIG. 14 is a perspective view illustrating a bent state of a hinge part of a refrigerator according to an embodiment of the present disclosure.

FIG. 14 is a perspective view illustrating a bent state of a hinge part of a refrigerator according to an embodiment of the present disclosure.

Referring to FIG. 14, the first bent portion 4611-3 is bent with respect to the first body 4611 at the first angle R2, and the second bent portion 4621-2 is bent with respect to the second body 4621 at the second angle R3.

As described above, in a state in which the sub door 400 is closed, the first bent portion 4611-3 and the second bent portion 4621-2 may be provided parallel to each other. That is, a bending direction of the first bent portion 4611-3 and a bending direction of the second bent portion 4621-2 may be the same (R2=R3). In other words, a direction in which the first bent portion 4611-3 is bent from the first body 4611 and a direction in which the second bent portion 4621-2 is bent from the second body 4621 may be the same.

Referring to FIG. 14, the first body 4611 includes a first portion 4611-1 connected to the first fixing piece 4613 and a second portion 4611-2 bent with respect to the first portion 4611-1 at the third angle R1 and connected to the first bent portion 4611-3.

That is, the second portion 4611-2 of the first body 4611 may be connected to the first bent portion 4611-3 while having a second angle R2.

In this way, the first body 4611 of the first hinge 461 is bent from the first portion 4611-1 at the third angle R1 and connected to the second portion 4611-2, and the second portion 4611-2 may be connected to the first bent portion 4611-3 while having the first angle R2. That is, the first hinge 461 may be formed by bending twice at the third angle R1 and the first angle R2. The second hinge 462 may be formed by bending once at the second angle R3.

The overall shape of the first hinge 461 may be the same as a shape of the second hinge 462 except for the first portion 4611-1. Here, the first portion 4611-1 may correspond to a portion bent at the third angle R1 with respect to the second portion 4611-2 corresponding to the second body 4621 of the second hinge.

The first portion 4611-1 may have an end 4611-4 connected to the first fixing piece 4613. The end 4611-4 may have the same thickness (step difference) as the stepped part 4615.

Referring to FIG. 14, the first body 4611 may have a first length T1. In FIG. 14, T1 is marked in parallel with the first portion 4611-1, but this is an exemplary expression. The first bent portion 4611-3 may extend from the first body 4611 by a second length T2.

As described above, since the first hinge 461 and the second hinge 462 have the same width, length, and bending angle, the second body 4621 may also have the first length T1. In addition, the second bent portion 4621-2 may extend from the second body 4621 by a second length T2.

As described above, since the first cover 464 may have the same shape as the first hinge 461, the first cover 464 includes the fourth body 4641 corresponding to the first body 4611 of the first hinge 461 and a fourth bent portion 4643 corresponding to portion 4611-3. In addition, the first cover 464 may include a third portion 4642 corresponding to the first portion 4611-1 of the first hinge 461.

Figure 15:
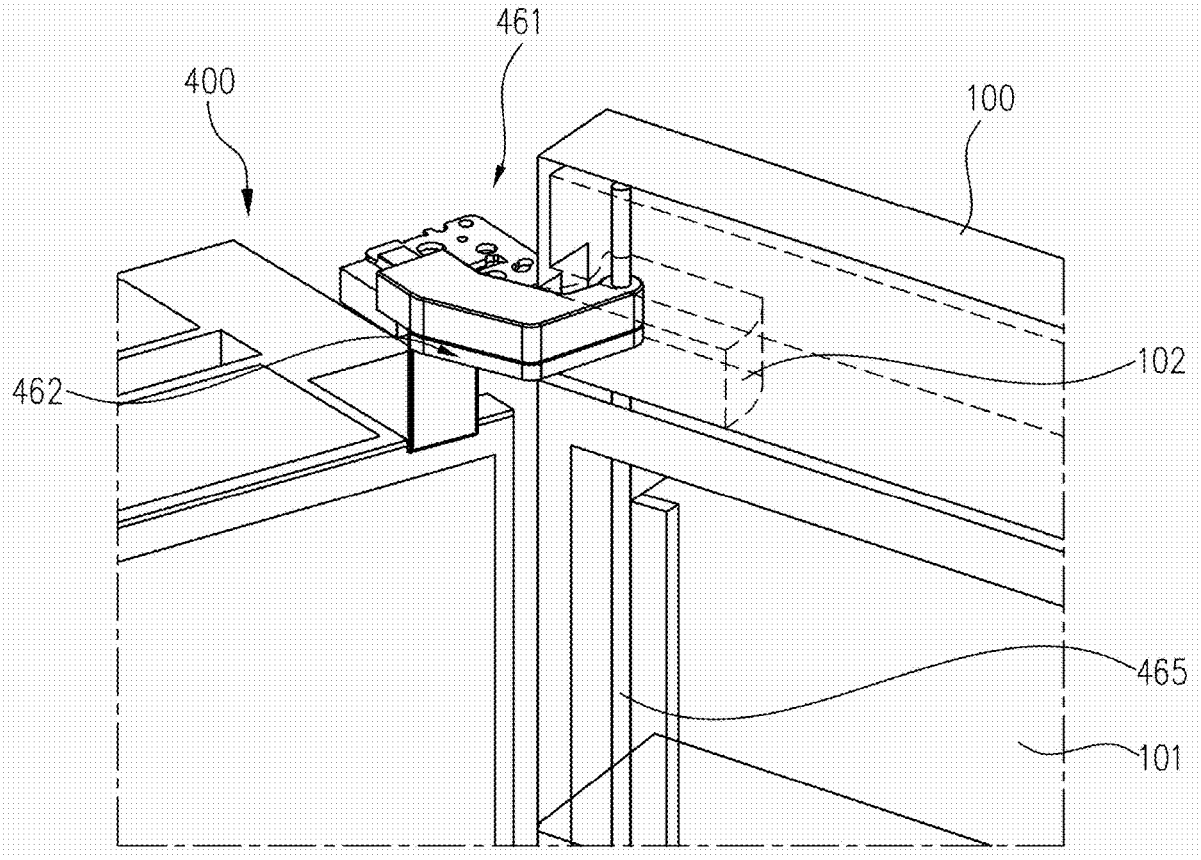
FIG. 15 is a perspective view illustrating an installation state of a hinge part of a refrigerator according to an embodiment of the present disclosure.
Figure 16:
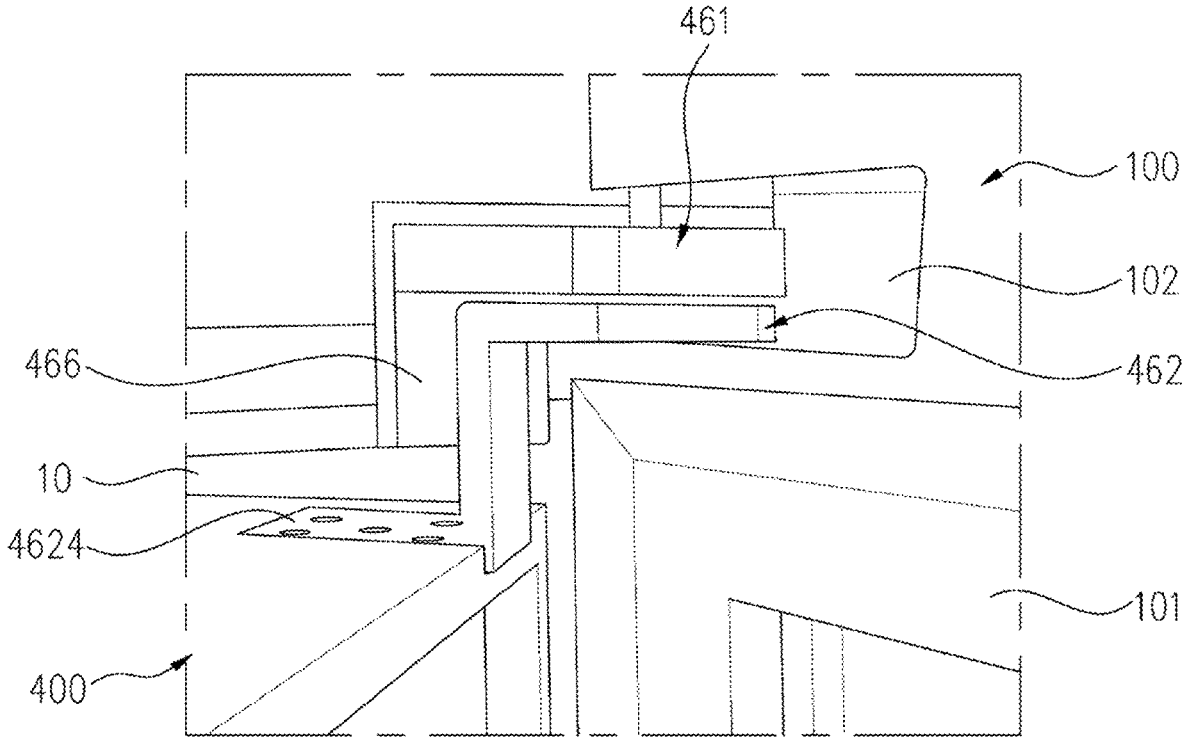
FIG. 16 is a photograph showing an installation state of a hinge part of a refrigerator according to an embodiment of the present disclosure.

FIG. 15 is a perspective view illustrating an installation state of a hinge part of a refrigerator according to an embodiment of the present disclosure. FIG. 16 is a photograph showing an installation state of a hinge part of a refrigerator according to an embodiment of the present disclosure.

FIG. 15 shows that the sub door 400 is in a closed state and the main door 100 is in an open state. FIG. 16 shows a state in which the sub door 400 is opened at a predetermined angle and the main door 100 is opened at a greater angle than the sub door 400.

Referring to FIGS. 15 and 16, at least some of the first hinge 461 and the second hinge 462 may be disposed in the installation groove 102 formed in the main door 100. In addition, as seen from FIGS. 15 and 16, reference numerals are omitted for brevity, but end portions of the first bent portion 4611-3 and the second bent portion 4621-2 of the first hinge 461 are within the installation groove 102. In addition, this installation groove 102 may be disposed above the main plane 101 of the main door 100.

Referring to FIG. 15, the pivot shaft 465 is installed in a direction perpendicular to the main door 100 at a corner side of the main door 100, and the first pivot hole 4616 and the second pivot hole 4622 are installed in combination with the pivot shaft 465. That is, the pivot shaft 465 may be positioned through the first pivot hole 4616 and the second pivot hole 4622.

At this time, although not separately marked in FIGS. 13 and 14 described with reference to the above, the pivot shaft 465 may also be installed through the first cover 464. However, when the installation groove 102 is positioned at an upper end of the main door 100, the pivot shaft 465 may not penetrate the first cover 464.

Although not shown as a separate drawing, when the main door 100 is closed in the state of FIG. 15, not only the first bent portion 4611-3 and the second bent portion 4621-2, but also the first body 4611 and the second body 4621 are installed within the installation groove 102.

Referring to FIG. 16, relative positions of the first hinge 461 and the second hinge 462 may be changed according to relative positions of the main door 100 and the sub door 400.

According to an exemplary embodiment, an airtight part (or seal) 466 may be provided to control cold air between the first hinge 461 and the second hinge 462. The airtight part 466 may be disposed through the first body 4611 of the first hinge 461. The airtight part 466 may also control cold air between the cabinet 10 and the first hinge 461.

As described above, the second body 4621 and the second fixing piece 4624 of the second hinge 462 may be connected to each other with a height step difference by the vertical extension 4623. That is, the vertical extension 4623 may have a height corresponding to a height difference between a portion of the cabinet 10 to which the first hinge 461 is fixed and a top surface of the sub door 400.

In this case, in a state in which the sub door 400 is closed, the airtight part 466 may be disposed in parallel to the vertical extension 4623. In some cases, when the sub door 400 is closed, the airtight part 466 may contact the vertical extension 4623 to control cold air. The airtight part 466 may contact the outside of the cabinet 10 and control cold air in the storeroom 11.

According to an exemplary embodiment, the airtight part 466 may be made of an elastic material such as rubber, and in a state in which the sub door 400 is closed, the airtight part 466 contacts the vertical extension 4623 to control cold air while maintaining airtightness. The airtight part 466 may control cold air of the storeroom 11 by contacting the outside of the cabinet 10 while maintaining airtightness.

Figure 17:
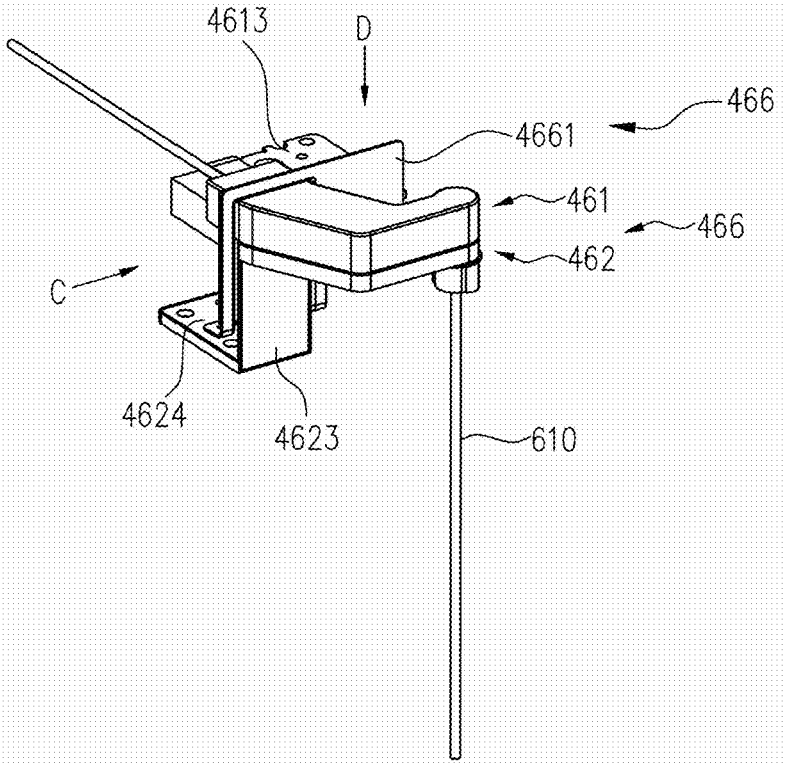
FIGS. 17 to 19 are perspective views showing a first state of a hinge part of a refrigerator according to an embodiment of the present disclosure.
Figure 18:
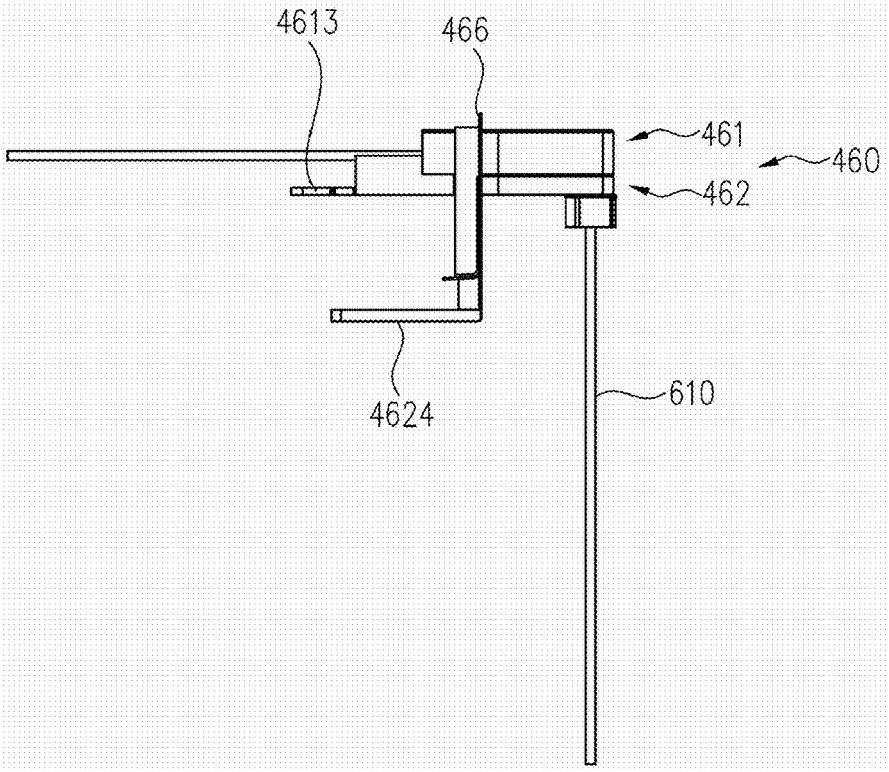
Figure 19:
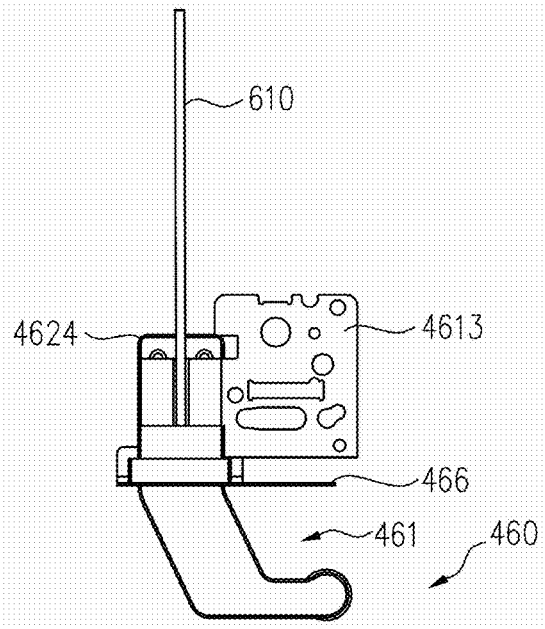
Figure 20:
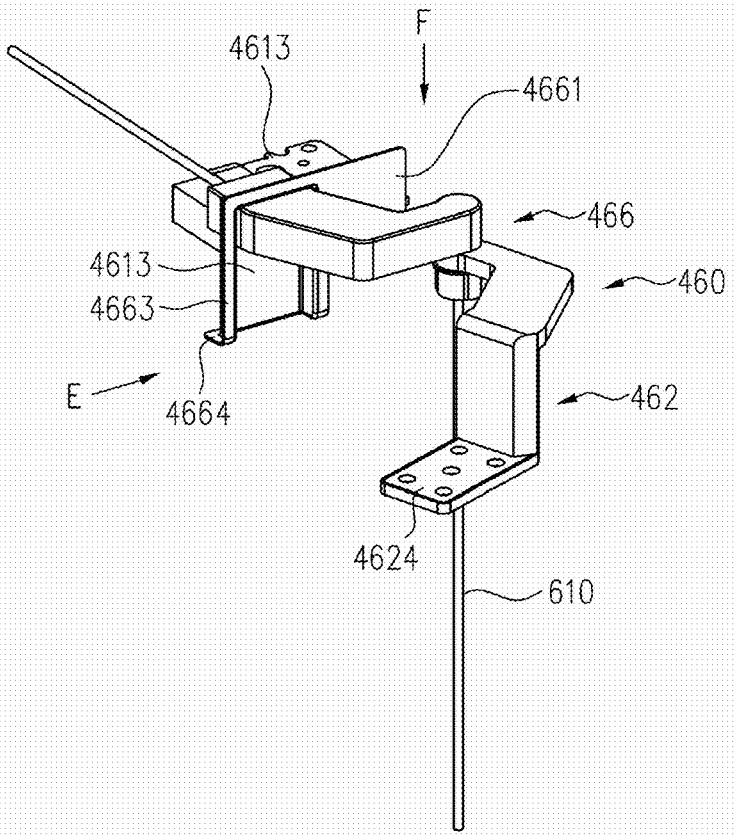
FIGS. 20 to 22 are perspective views showing a second state of a hinge part of a refrigerator according to an embodiment of the present disclosure.
Figure 21:
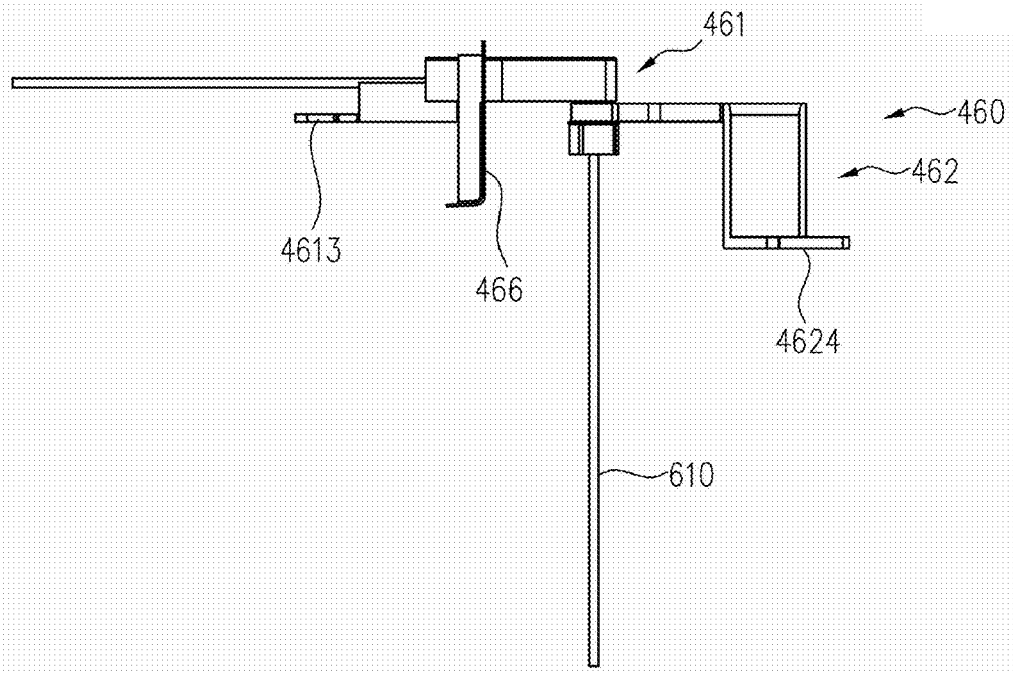
Figure 22:
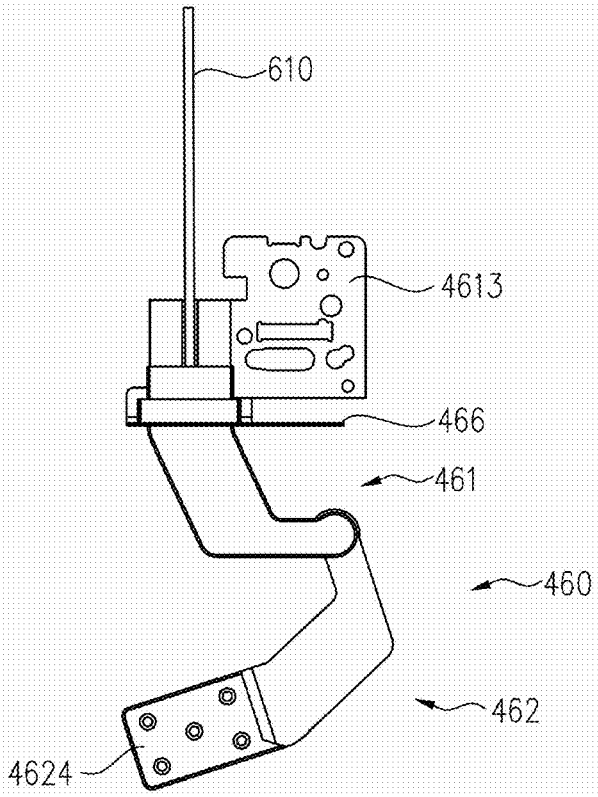

FIGS. 17 to 19 are perspective views showing a first state of a hinge part of a refrigerator according to an embodiment of the present disclosure. FIGS. 20 to 22 are perspective views showing a second state of a hinge part of a refrigerator according to an embodiment of the present disclosure.

In detail, FIGS. 17 to 19 show a position state of the hinge part 460 in a state in which the sub door 400 is closed. FIGS. 20 to 22 show a position state of the hinge part 460 in a state in which the sub door 400 is open. Likewise, it may be seen that the state of the hinge part 460 is changed depending on the position state of the sub door 400.

FIG. 18 is a view viewed from a direction C in FIG. 17, and FIG. 19 is a view viewed from a direction D in FIG. 17. FIG. 21 is a view viewed from a direction E of FIG. 20, and FIG. 22 is a view viewed from a direction F of FIG. 21.

Hereinafter, a positional relationship of the hinge part 460 will be described with reference to FIGS. 17 to 22. For convenience of illustration, some reference numerals are omitted in FIGS. 17 to 22.

The state of FIG. 17 shows the position state of the hinge part 460 when the sub door 400 is closed. The state of the hinge part 460 may be the same as that shown in FIG. 15. FIG. 17 is different from FIG. 15 in that the airtight part 466 is shown together.

First, the airtight part 466 will be described in detail with reference to FIGS. 17 and 20.

As described above, FIG. 17 shows a state in which the airtight part 466 overlaps the vertical extension 4623 as the sub door 400 is closed, that is, as the storage space 440 of the sub door 400 is positioned within the storeroom 11.

Referring to FIG. 17, the airtight part 466 may include a first flat portion 4661. The first flat portion 4661 may occupy a main area of the airtight part 466.

Referring to FIG. 20, the first body 4611 of the first hinge 461 may pass through the airtight part 466. That is, the first body 4611 may be surrounded by the airtight part 466, and accordingly, the airtight part 466 may ensure the airtightness of the first hinge 461.

According to an exemplary embodiment, the airtight part 466 may include an edge 4663 surrounding the first body 4611 and a second flat portion 4662 disposed inside the edge 4663.

In addition, the airtight part 466 may further include a bent end 4664 bent at one end of the edge 4663 and the second flat portion 4662.

In this case, the bent end 4664 may be formed by bending the lower ends of the edge 4663 and the second flat portion 4662 toward the cabinet 10.

In this configuration of the airtight part 466, as the sub door 400 is closed, in a state in which the airtight part 466 overlaps the vertical extension 4623, the second flat portion 4662 of the airtight part 466 faces the second hinge 462. Specifically, in a state in which the airtight part 466 overlaps the vertical extension 4623, the second flat portion 4662 of the airtight part 466 may face the vertical extension 4623 of the second hinge 462.

FIG. 19 shows a relative positional relationship between the first fixing piece 4613 of the first hinge 461, the remaining components of the first hinge 461, and the airtight part 466.

As seen from FIG. 20, since the first hinge 461 is fixed to the cabinet 10 by the first fixing piece 4613 and the second hinge 462 is fixed to the sub door 400 by the second fixing piece 4624, the second hinge 462 rotates with respect to the first hinge 461 as much as the sub door 400 is open and rotated with respect to the cabinet 10.

That is, it may be seen that the sub door 400 is coupled with the second hinge 462 and rotates with respect to the first hinge 461, the first hinge 461 is fixed to the cabinet 10, and the pivot shaft 465 is installed in the main door 100, and thus the main door 100 may rotate relatively freely with respect to the first hinge 461 and the second hinge 462. Here, the reason why rotation of the main door 100 is described to be relatively free here is that the main door 100 is not capable of getting closer to the cabinet 10 than the second hinge 462. This positional relationship may be seen more clearly in FIG. 22 viewed from above (direction F in FIG. 20).

The hinge part 460 according to an embodiment of the present disclosure as described above is connected to each of the cabinet 10, the main door 100, and the sub door 400, and the connection is achieved by one pivot shaft 465, and thus the main door 100 and the sub door 400 may be opened separately or simultaneously without a separate fixing device.

That is, two hinges including the first hinge 461 and the second hinge 462 are connected by one pivot (coaxial connection), and thus the main door 100 and the sub door 400 may be opened separately or simultaneously.

In addition, the conducting wire 610 may be inserted into the hinge part 460 to operate an electric device mounted on a door (e.g., the main door 100).

One side of the hinge part 460 is installed in the installation groove 102 depressed on an outer surface of the main door 100, and thus the sub door 400 may be disposed inside the storeroom 11 of the cabinet 10 without interference.

In addition, the first hinge 461 and the second hinge 462 are bent at the same bending angle and disposed in parallel, and thus the aesthetics of the hinge part 460 is improved when viewed by a user. That is, a sight of the user is not hindered by the structure of the hinge part 460.

The present disclosure provides a refrigerator for efficiently configuring a storage space divided according to a partition of a refrigerator door in consideration of the volume of the refrigerator.

The present disclosure provides a refrigerator in which a main door and a sub door are opened and closed efficiently in a double door structure including a main door and a sub door.

The present disclosure provides a refrigerator in which a main door and a sub door are opened separately or simultaneously without a separate fixing device by configuring a hinge part connected by one pivot shaft.

The present disclosure provides a refrigerator for operating an electric device mounted on a door (e.g., a main door) within a hinge part.

The present disclosure provides a refrigerator in which a sub door is disposed within a storeroom of a cabinet without interference.

The present disclosure provides a refrigerator for improving aesthetics when a hinge part is shown to a user.

Furthermore, there are additional technical purposes not mentioned here. A person skilled in the art understands additional technical purposes through the entirety of the specification and drawings.

The present disclosure provides a refrigerator including a main door rotatably provided in the cabinet by a first hinge to open and close the storeroom, and a sub door disposed between the main door and the storeroom, rotatably provided with respect to the main door by a second hinge, and defining a storage space disposed inside the storeroom in a closed state, and in this case, the first hinge and the second hinge are bent at the same bending angle and are disposed in parallel to each other or overlap each other.

In this case, the first hinge may include a first body connected between the cabinet and the main door and a first pivot hole installed in a pivot shaft located on a side of the main door.

In addition, the second hinge may include a second body connected between the main door and the sub door, and a second rotation hole located on a side of the main door and installed in the pivot shaft.

In addition, the first body may include a first bent portion bent in a direction perpendicular to a pivot shaft of the first hinge, and the second body may include a second bent portion bent in a direction perpendicular to the pivot shaft of the second hinge.

In this case, the first bent portion and the second bent portion may be positioned parallel to or overlap each other. Bending directions of the first bent portion and the second bent portion may be the same. Bending angles of the first bent portion and the second bent portion may be the same.

At least a portion of the first hinge and the second hinge may be located inside an installation groove formed in the main door.

In detail, according to a first aspect of the above purpose of the present disclosure, a refrigerator includes a cabinet including a storeroom therein, a main door rotatably provided in the cabinet by a first hinge to open and close the storeroom, a sub door disposed between the main door and the storeroom, rotatably provided with respect to the main door by a second hinge, and defining a storage space disposed inside the storeroom in a closed state, wherein the first hinge includes a first body including a first bent portion bent in a perpendicular direction to a pivot shaft, and a first pivot hole installed in the pivot shaft positioned at a side of the main door, wherein the second hinge includes a second body including a second bent portion bent in a perpendicular direction to the pivot shaft, and a second pivot hole installed in the pivot shaft positioned at the side of the main door; and at least a portion of the first bent portion and at least a portion of the second bent portion are positioned in an installation groove formed in the main door.

According to an exemplary embodiment, the sub door may include an accommodation part defining the storage space.

According to an exemplary embodiment, the installation groove may be spaced downward from a top of the main door.

According to an exemplary embodiment, the first bent portion may be bent at a first angle with respect to the first body, and the second bent portion may be bent at a second angle with respect to the second body.

According to an exemplary embodiment, the first angle and the second angle may be equal to each other.

According to an exemplary embodiment, the first angle and the second angle may be greater than a right angle.

According to an exemplary embodiment, the first hinge may further include a first cover covering the first body and the first bent portion.

According to an exemplary embodiment, the first body and the second body may overlap each other in a perpendicular direction in a state in which the main door and the sub door are coupled.

According to an exemplary embodiment, at least a portion of the first hinge and the second hinge may be positioned within an installation groove formed in the main door.

According to an exemplary embodiment, the first hinge may include a first fixing piece connected to the first body and fixed to the cabinet, and the second hinge may include a second fixing piece connected to the second body and fixed to the sub door.

According to an exemplary embodiment, the second body and the second fixing piece may be connected to each other with a height step difference by a vertical extension.

According to an exemplary embodiment, the refrigerator may further include an airtight part configured to control cold air between the first hinge and the second hinge.

According to an exemplary embodiment, the first body may be disposed through the airtight part.

According to an exemplary embodiment, the airtight part may include a first flat portion, an edge surrounding the first body, and a second flat portion positioned inside the edge.

According to an exemplary embodiment, the airtight part may include a bent end bent at one end of the edge and the second flat portion.

According to an exemplary embodiment, the bent end may be bent toward the cabinet from a lower end of the edge and the second flat portion.

According to an exemplary embodiment, the second flat portion may face the second hinge.

According to an exemplary embodiment, the first body and the first fixing piece may have a height difference.

According to an exemplary embodiment, the first body may include a first portion connected to the first fixing piece, and a second portion bent at a second angle with the first portion and connected to the first bent portion.

According to an exemplary embodiment, the first body may include a conducting wire groove in which a conducting wire is installed.

According to an exemplary embodiment, the first pivot hole and the conducting wire groove may be connected to each other.

According to an exemplary embodiment, a spacer may be disposed between the first pivot hole and the second pivot hole.

According to an exemplary embodiment, a shaft extension extending in a direction of a pivot shaft may be disposed in the second pivot hole.

According to a second aspect of the above purpose of the present disclosure, a refrigerator includes a cabinet including a storeroom therein, a main door rotatably provided in the cabinet by a first hinge to open and close the storeroom, and a sub door disposed between the main door and the storeroom, rotatably provided with respect to the main door by a second hinge, and defining a storage space disposed inside the storeroom in a closed state, wherein the first hinge has an end coupled to the cabinet to allow the main door to rotate with respect to the cabinet and a remaining end installed at a first position of the pivot shaft, the second hinge has an end coupled to the sub door to allow the sub door to rotate with respect to the main door and a remaining end coupled at a second position of the pivot shaft, and a height difference between the end and the remaining end of the second hinge is greater than a height difference between the end and the remaining end of the first hinge.

According to an exemplary embodiment, the end and the remaining end of the second hinge may be connected with the height difference by a vertical extension.

According to an exemplary embodiment, the second body and the second fixing piece may be connected with a height step difference by the vertical extension.

According to an exemplary embodiment, the remaining end of the first hinge and the remaining end of the second hinge may be positioned in an installation groove formed in the main door.

According to a third aspect of the above purpose of the present disclosure, a refrigerator includes a cabinet including a storeroom therein, a main door rotatably provided in the cabinet by a first hinge to open and close the storeroom, and a sub door disposed within the cabinet, rotatably provided with respect to the main door by a second hinge, and including an accommodation part defining a storage space disposed within the storeroom in a closed state, wherein the first hinge includes a first body connected between the cabinet and the main door, and a first pivot hole installed in a pivot shaft positioned at a side of the main door, the second hinge includes a second body connected between the main door and the sub door, and a second pivot hole positioned at the side of the main door and installed in the pivot shaft, the first body and the second body each have a flat shape, and outlines of the first body and the second body are provided in parallel to each other in a state in which the main door and the sub door are coupled.

According to an embodiment of the present disclosure, a storage space divided and formed by a partition of a refrigerator door is efficiently configured in consideration of the volume of the refrigerator using a double door structure including a main door and a sub door.

In a double door structure including a main door and a sub door, the main door and the sub door are opened and closed efficiently.

Specifically, in the double door structure including the main door and the sub door, the main door and the sub door are separately opened or simultaneously opened without a separate fixing device by configuring a hinge part connected by one pivot shaft.

A conducting wire is provided in the hinge part to operate an electric device mounted on a door (e.g., main door).

One side of the hinge part is installed in the installation groove formed on an outer surface of the main door, and thus the sub door is disposed inside the storeroom of the cabinet without interference.

The first hinge and the second hinge are bent at the same bending angle and disposed in parallel, and thus aesthetics is improved when the hinge part is seen by a user. That is, a sight of the user is not be hindered by the structure of the hinge part.

The thickness of the main door is reduced. Therefore, it is possible to prevent an unnecessary increase in the volume of the entire refrigerator.

In addition, the main door basket and the sub door basket do not interfere with each other.

Furthermore, there are additional technical effects not mentioned here. A person skilled in the art understands additional technical effects through the entire meaning of the specification and drawings.

The above description is merely illustrative of the technical idea of the present disclosure. Those of ordinary skill in the art to which the present disclosure pertains will be able to make various modifications and variations without departing from the essential characteristics of the present disclosure.

Therefore, embodiments disclosed in the present disclosure are not intended to limit the technical idea of the present disclosure, but to describe, and the scope of the technical idea of the present disclosure is not limited by such embodiments.

The scope of protection of the present disclosure should be interpreted by the claims below, and all technical ideas within the scope equivalent thereto should be construed as being included in the scope of the present disclosure.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet including a first storage space therein;

a main door rotatably coupled to the cabinet by a first hinge and configured to open and close the first storage space; and a sub door positioned between the main door and the first storage space, rotatably coupled to the main door by a second hinge, and defining a second storage space disposed inside the first storage space when the sub door is closed, wherein:

the first hinge includes a first end coupled to the cabinet and a second end coupled to a first section of a pivot shaft of the main door such that the main door rotates with respect to the cabinet; and the second hinge includes a first end coupled to the sub door and a second end coupled at a second section of the pivot shaft such that the sub door rotates with respect to the main door, wherein the first end and the second end of the second hinge are connected by a vertical extension such that the first end and the second end of the second hinge are provided at different vertical heights of the refrigerator, wherein a second cover is disposed on the second hinge, and wherein the second cover includes a coupler bent in a vertical direction such that the coupler overlaps and combines with the vertical extension of the second hinge.

2. The refrigerator of claim 1, wherein the first hinge includes:

a first plate;

a first extension extending horizontally from the first plate toward a pivot shaft of the main door; and a first pivot hole provided in the first extension and coupled to the pivot shaft, wherein the second hinge includes:

a second plate;

a second extension extending horizontally from the second plate toward the pivot shaft; and a second pivot hole provided in the second extension and coupled to the pivot shaft.

3. The refrigerator of claim 2, wherein the first extension and the second extension are positioned in parallel to each other.

4. The refrigerator of claim 2, wherein the first extension extends at a first angle with respect to the first plate, and the second extension extends at a second angle with respect to the second plate.

5. The refrigerator of claim 4, wherein the first angle and the second angle are equal to each other.

6. The refrigerator of claim 4, wherein the first angle and the second angle are greater than a right angle.

7. The refrigerator of claim 2, wherein the first plate and the second plate overlap each other in a vertical direction.

8. The refrigerator of claim 1, wherein at least a portion of the first extension and at least a portion of the second extension are positioned in an installation groove formed in the main door, and wherein the installation groove is spaced downward from a top of the main door.

9. The refrigerator of claim 1, wherein the first hinge includes a first fixing plate connected to the first plate and fixed to the cabinet; and wherein the second hinge includes a second fixing plate connected to the second plate and fixed to the sub door.

10. The refrigerator of claim 9, wherein the second plate and the second fixing plate are connected to each other by the vertical extension such that the second plate and the second fixing plate are provided at different heights.

11. The refrigerator of claim 2, wherein a shape of the second cover is substantially the same as a shape of the second hinge.

12. The refrigerator of claim 11, wherein the second cover includes:

a third body corresponding to the second plate;

a third bent portion corresponding to the second extension; and a third pivot hole corresponding to the second pivot hole.

13. The refrigerator of claim 12, wherein the coupler is bent in the vertical direction from the third body.

14. The refrigerator of claim 13, wherein the first hinge further includes a first cover covering the first plate and the first extension.

15. The refrigerator of claim 14, wherein a shape of the first cover is substantially the same as a shape of the first hinge.

16. The refrigerator of claim 15, wherein the first cover includes:

a top surface covering the first hinge; and a side surface extending from the top surface and contacting an external shape of the first hinge.

17. The refrigerator of claim 9, wherein the first plate and the first fixing plate have a height difference.

18. The refrigerator of claim 9, wherein the first plate includes:

a first region connected to the first fixing plate; and a second region extending at a second angle with respect to the first portion-region and connected to the first extension.

19. The refrigerator of claim 2, wherein the first plate includes a wire groove configured to receive a wire.

20. The refrigerator of claim 19, wherein the first pivot hole and the wire groove are connected to each other.

21. The refrigerator of claim 2, further comprising a spacer provided between the first pivot hole and the second pivot hole.

22. The refrigerator of claim 2, wherein a shaft extension extending in an extension direction of the pivot shaft is received in the second pivot hole.

23. A refrigerator comprising:

a cabinet including a first storage space therein;

a main door rotatably coupled to the cabinet by a first hinge and configured to open and close the first storage space; and a sub door positioned between the main door and the first storage space, rotatably coupled to the main door by a second hinge, and defining a second storage space positioned inside the first storage space when the sub door is closed, wherein:

the first hinge has a first end coupled to the cabinet and a second end coupled to a first section of a pivot shaft of the main door such that the main door rotates with respect to the cabinet; and the second hinge has a first end coupled to the sub door and a second end coupled at a second section of the pivot shaft such that the sub door rotates with respect to the main door, wherein the first end and the second end of the second hinge are connected by a vertical extension such that the first end and the second end of the second hinge are provided at different vertical heights of the refrigerator, and wherein a seal extends downwardly from the first hinge to correspond to the vertical extension of the second hinge, and a lower portion of the seal is spaced apart from the first end of the second hinge.

24. The refrigerator of claim 23, wherein the first hinge includes:

a first plate; and a first extension extending horizontally from the first plate toward the pivot shaft of the main door, and wherein the seal faces the vertical extension of the second hinge.

25. The refrigerator of claim 24, wherein the first plate extends through the seal.

26. The refrigerator of claim 25, wherein the seal includes:

a first flat region;

an edge surrounding the first plate; and a second flat region positioned inside the edge.

27. The refrigerator of claim 26, wherein the seal includes a bent end extending at an angle from an end of the edge and the second flat region.

28. The refrigerator of claim 27, wherein the bent end extends toward the cabinet from a lower end of the edge and the second flat region.

29. The refrigerator of claim 26, wherein the second flat region faces the second hinge.

* * * * *